US006666738B1

(12) United States Patent
Kado et al.

(10) Patent No.: US 6,666,738 B1
(45) Date of Patent: Dec. 23, 2003

(54) PLASMA DISPLAY PANEL MANUFACTURING METHOD FOR ACHIEVING LUMINESCENCE CHARACTERISTICS

(75) Inventors: Hiroyuki Kado, Ibaraki (JP); Mitsuhiro Ohtani, Sakai (JP); Masaki Aoki, Mino (JP)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 0 days.

(21) Appl. No.: 09/720,015

(22) PCT Filed: Jun. 25, 1999

(86) PCT No.: PCT/JP99/03425

§ 371 (c)(1),
(2), (4) Date: Feb. 12, 2001

(87) PCT Pub. No.: WO99/67803

PCT Pub. Date: Dec. 29, 1999

(30) Foreign Application Priority Data

Jun. 25, 1998 (JP) ..... 10-178550
Sep. 22, 1998 (JP) ..... 10-267897

(51) Int. Cl.[7] ..... H01J 9/39
(52) U.S. Cl. ..... 445/6; 445/40
(58) Field of Search ..... 445/6, 40, 24, 445/25

(56) References Cited

U.S. PATENT DOCUMENTS

| | | | | |
|---|---|---|---|---|
| 3,213,515 A | * | 10/1965 | Koury et al. | 445/6 |
| 3,492,598 A | * | 1/1970 | MacNair | 445/6 |
| 3,743,879 A | | 7/1973 | Kupsky | |
| 4,849,674 A | * | 7/1989 | Cherry et al. | 313/503 |
| 5,207,607 A | * | 5/1993 | Nagano et al. | 445/25 |
| 5,564,958 A | * | 10/1996 | Itoh et al. | 445/6 |
| 6,006,003 A | * | 12/1999 | Kim | 445/25 |
| 6,236,159 B1 | * | 5/2001 | Inoue et al. | 313/582 |

FOREIGN PATENT DOCUMENTS

| | | | |
|---|---|---|---|
| EP | 97-79643 A2 | | 6/1997 |
| EP | 97-79643 A3 | | 3/1999 |
| FR | 2696867 | | 4/1994 |
| JP | 3/025826 | | 2/1991 |
| JP | 3/077233 | | 4/1991 |
| JP | 4-05-234512 A | * | 9/1993 |

* cited by examiner

*Primary Examiner*—Kenneth J. Ramsey

(57) ABSTRACT

The object of this invention is to provide a plasma display panel in which an aging process essential to the manufacturing process generates minimal phosphor deterioration, enabling a relatively high luminous efficiency and high quality color production to be produced. To achieve this object, the aging process takes place while gas generated inside the panel is evacuated. Alternatively, after completion of the aging process, the phosphor of the whole panel is heated to restore heat deterioration.

39 Claims, 20 Drawing Sheets

PLASMA DISPLAY PANEL MANUFACTURING METHOD FOR ACHIEVING LUMINESCENCE CHARACTERISTICS

INDUSTRIAL FIELD OF USE

The present invention relates to a manufacturing method for a plasma display panel used to display images on computer monitors, televisions and the like.

RELATED ART

The following is an explanation of a display panel in the related art with reference to the drawings. FIG. 21 is a simplified cross sectional of an alternating current (AC) plasma display panel (hereafter referred to as a PDP).

In FIG. 21, discharge electrodes 211 are formed on a front glass plate 210. These are then covered by a layer of dielectric glass 212 and a protective dielectric layer 213, composed of magnesium oxide (MgO). A description of this technique may be found in Japanese Laid-Open Patent No. 5-342991.

Address electrodes 221 are formed on a rear glass plate 220, and covered by a visible light reflective layer 222 and partitions 223. A phosphor layer 224 is placed on top of this. Spaces 230 are discharge spaces which enclose a discharge gas. Three types of phosphors, for producing the colors red, green and blue, are arranged in order in the phosphor layer 224 to produce a color display. The phosphors in layer 224 are excited by short-wave ultra-violet rays generated by electric discharge on a wavelength of 147 nm for example, and emit visible light.

The phosphors that make up the phosphor layer 224 are generally produced using these compounds:

| | |
|---|---|
| Blue phosphor: | $BaMgAl_{10}O_{17}$ : Eu |
| Green phosphor: | $Zn_2SiO_4$ : Mn or $BaAl_{12}O_{19}$ : Mn |
| Red phosphor: | $Y_2O_3$ : Eu or $(Y_xGd_{1-x})$ $BO_3$ : Eu |

The following is an explanation of a PDP manufacturing method in the related art.

Firstly, discharge electrodes are formed on a front glass plate, and a dielectric layer made from dielectric glass is formed to cover the discharge electrodes. A protective layer made from MgO is formed on top of the dielectric layer. Next, address electrodes are formed on a back glass plate, and a visible light reflective layer made from dielectric glass formed on top of this. Then glass partitions are produced on top of this at fixed intervals.

A phosphor layer is formed by alternately introducing phosphor pastes for the red, green and blue phosphors produced as above into the spaces between the partitions. Next this phosphor layer is baked at a temperature of around 500° C. to eliminate resin and similar substances from the paste (Phosphor Baking Process).

After the phosphor layer has been baked, a glass frit for sealing the front and back plates together is applied to the edge of the back glass plate, and then pre-baking is performed at around 350° C. to eliminate resin and the like from the glass frit (Sealing Process, Pre-baking Process).

After this, the front glass plate, formed from the discharge electrodes, the dielectric glass layer and the protective layer, and the back glass plate are placed together with the partitions sandwiched between them and the display electrodes and address electrodes at right angles. The panel is then heated at around 450° C. to seal the edges of the plates together with glass frit (Sealing Process).

After this, the inside of the panel is evacuated by heating it to a certain temperature of around 350° C. (Evacuation Process) and a discharge gas is introduced at a certain pressure once this process is completed.

A panel manufactured using the above processes exhibits great variations in luminescence and discharge characteristics during the initial stage of ignition. Accordingly, luminescence and discharge characteristics need to be stabilized by ensuring that the manufactured panel discharges electricity only during a certain time period. This process is known as the aging process.

However, in the PDP manufacturing process used in the related art, a particular problem is posed by the fact that the aging process for stabilizing the luminescence and discharge characteristics actually causes a deterioration in the luminescence characteristics.

One reason for this is the deterioration in the phosphors used. Thee compound $BaMgAl_{10}O_{17}$:Eu used as a blue phosphor is particularly prone to deterioration during the aging process, resulting in a decrease in luminous intensity and a deterioration in luminescent chromaticity.

DISCLOSURE OF THE INVENTION

In view of the above problems, the object of the present invention is to provide a PDP that may undergo the necessary aging process with minimal phosphor deterioration, and that has a comparatively high luminous efficiency as well as high-quality color reproduction.

In order to achieve the above object, a PDP manufacturing process is performed in the following way. First, a front plate and a back plate, on at least one of which discharge electrodes have been arranged and on at least one of whose inner surfaces a phosphor layer has been formed are sealed together so that an inner space is formed between them. Then an aging process in which a required discharge voltage is applied to the discharge electrodes is performed. The aging process includes an introducing process in which a discharge gas with a partial steam pressure of 15 Torr or less is newly introduced into the inner space from the outside and an evacuating process, in which discharge gas is evacuated from the inner space. By performing the introducing process together with the evacuating process, discharge gas can be circulated continuously or intermittently through the inner space, while a required discharge voltage is applied to the discharge electrodes, thereby enabling discharge to be produced.

Furthermore, a PDP manufacturing process may be performed in the following way. First, a front plate and a back plate, on at least one of discharge electrodes have been arranged and on at least one of whose inner surfaces a phosphor layer has been formed are sealed together so that an inner space is formed between them. Then an aging process in which a required discharge voltage is applied to the discharge electrodes is performed. The aging process includes an introducing process in which a discharge gas with a partial steam pressure of 15 Torr or less is newly introduced into the inner space from the outside and an evacuating process, in which discharge gas is evacuated from the inner space. The discharge generated when a required discharge voltage is applied to the discharge electrodes is divided into a plurality of discharge periods. By performing the introducing and evacuating processes in the intervals between discharge periods, discharge gas can be circulated through the inner space.

Here, the introducing process introduces gas via a first air vent formed in the panel, and the evacuating process evacuates gas via a second air vent formed in the panel.

Consequently, the PDP subject to the aging process has the following structure. A plurality of discharge spaces are formed by arranging a plurality of partitions to divide up the inner space between the front plate and the back plate and a sealing glass layer for sealing the panel is included between the perimeters of the front plate and the back plate. Then a first space connected to the discharge spaces formed by the plurality of partitions is formed between first ends of the plurality of partitions and the sealing glass layer, and a second space connected to the discharge spaces is formed between second ends of the plurality of partitions and the sealing glass layer. The first air vent forms a connection with the first space and the second air vent with the second space. Then this structure is subject to an aging process in which the discharge gas is circulated through the discharge space. This is achieved by performing the introducing process by introducing the discharge gas into the first space via the first air vent, and the evacuating process by evacuating the discharge gas from the second space via the second air vent.

The PDP subjected to the aging process further includes a structure in which a minimum distance between partition ends of the plurality of partitions, excluding at least a partition furthest from the first air vent, and the sealing glass layer bordering the first space is more than a minimum distance between the sealing glass layer parallel to the partitions and an adjacent partition.

The PDP subjected to the aging process further includes a structure in which one part of each of the outermost partitions among the plurality of partitions is connected with one part of the sealing glass layer to prevent discharge gas from flowing into space between the outermost partitions and the sealing glass layer.

The PDP subjected to the aging process further includes a structure in which the first air vent is formed in the vicinity of one of the outermost partitions, and the second air vent is formed in the vicinity of the other outermost partition, on the opposite side to the first air vent.

A plurality of discharge spaces are formed by arranging a plurality of partitions to divide up the inner space between the front plate and the back plate and a sealing glass layer for sealing the panel is included between the perimeters of the front plate and the back plate. A barrier is further included between the front and back plates around the inside of the sealing glass layer. Then a first space connected to the discharge spaces formed by the plurality of partitions is formed between first ends of the plurality of partitions and the barrier, and a second space connected to the discharge spaces is formed between second ends of the plurality of partitions and the barrier. The first air vent forms a connection with the first space and the second air vent with the second space. Here the above structure is subject to an aging process in which the discharge gas is circulated through the discharge space. This is achieved by performing the introducing process by introducing the discharge gas into the first space via the first air vent, and the evacuating process by evacuating the discharge gas from the second space via the second air vent.

The PDP subject to the aging process further includes a structure in which a minimum distance between partition ends of the plurality of partitions, excluding at least a partition furthest from the first air vent, and the barrier bordering the first space is more than a minimum distance between the barrier parallel to the partitions and an adjacent partition.

The PDP subject to the aging process further includes a structure in which one part of each of the outermost partitions among the plurality of partitions and one part of the barrier are connected to prevent discharge gas from flowing into space between the outermost partitions and the barrier.

The PDP subject to the aging process further includes a structure in which the first air vent is formed in the vicinity a of one of the outermost partitions, and the second air vent is formed in the vicinity of the other outermost partition, on the opposite side to the first air vent.

In this kind of structure, discharge gas mainly flows through a plurality of gas passages leading from the first to the second space leading from the first space to the second space, and is designed so that discharge gas can flow more freely into gas passages being used as discharge spaces than into other gas passages. This prevents deterioration in the phosphors during the aging process.

The partial pressure of steam contained in the discharge gas introduced into the inner space should preferably be 10 torr or less, 5 torr or less, 1 torr or less or even 0.1 torr or less.

If achievable, the vaporization point should be further lowered to 10° C. or less, 1° C. or less, −20° C. or less, or even −40° C. or less.

An inert gas may be used as the discharge gas introduced into the inner space. Helium, neon, argon or xenon may be used as this gas.

In order to achieve the above object, a PDP manufacturing process is further performed in the following way. First, a front plate and a back plate, on at least one of which discharge electrodes have been arranged and on at least one of whose inner surfaces a phosphor layer has been formed are sealed together so that an inner space is formed between them. Then a heating process for heating phosphors in the phosphor layer is performed after the aging process has been completed. This heating process enables the characteristics of the phosphors to be restored.

The heating process following the aging process should preferably heat the phosphors to as high a temperature as possible, specifically of 300° C or more. If possible, the phosphors should be heated to an even higher temperature, such as 370° C. or more, 400° C. or more or even 500° C. or more.

The phosphors may be heated by heating the whole panel in an oven at a specified temperature, by concentrating a laser beam on the part of the panel on which the phosphors are arranged or by circulating a heating medium through the inner space. If the whole panel is heated using an oven, the panel cannot be heated at a temperature higher than the softening point of the glass used to seal the front and back plates of the panel together. If the more localized methods of a laser beam or heating medium are used to heat the panel, however, it can be heated to a higher temperature.

The heating process following the aging process (if heating in an oven or using a laser) should preferably be performed while the gas in the inner space is being evacuated.

The heating process following the aging process (if heating in an oven or using a laser) may also be performed by heating the panel after the gas in the inner space has been evacuated and dry gas introduced.

The heating process following the aging process (if heating in an oven or using a laser) may also be performed by heating the panel while dry gas is circulated through two or more air vents formed in the panel.

The dry gas may be an inert gas, and preferably should include oxygen.

The introduced dry gas may also be evacuated from an inner space heated by the heating process following the aging process (if heating in an oven or using a laser) while the panel is still hot.

If the heating process takes place with gas still circulating through the discharge space (if heating in an oven while gas is circulating in the discharge space, or using a laser or a heating medium), the rate of exchange is higher if the structure subjected to the heating process is one in which gas is circulated actively through the discharge space as described above, making this kind of structure preferable.

By using the above manufacturing method to restrict deterioration caused in particular to the blue phosphor, a PDP with superior luminescence characteristics can be obtained. Specifically, a PDP in which a color temperature of light emitted when all of the cells are ignited by applying the same power to each cell is 7000K can be obtained.

Furthermore, a PDP in which the peak intensity ratio for the light spectrums of blue light emitted by the blue cells and green light emitted by the green cells is greater than or equal to 0.8 can be obtained when cells in which blue and green phosphors have been arranged are ignited by applying the same power to each cell.

PREFERRED EMBODIMENTS OF THE PRESENT INVENTION

First Embodiment

Figure 1:
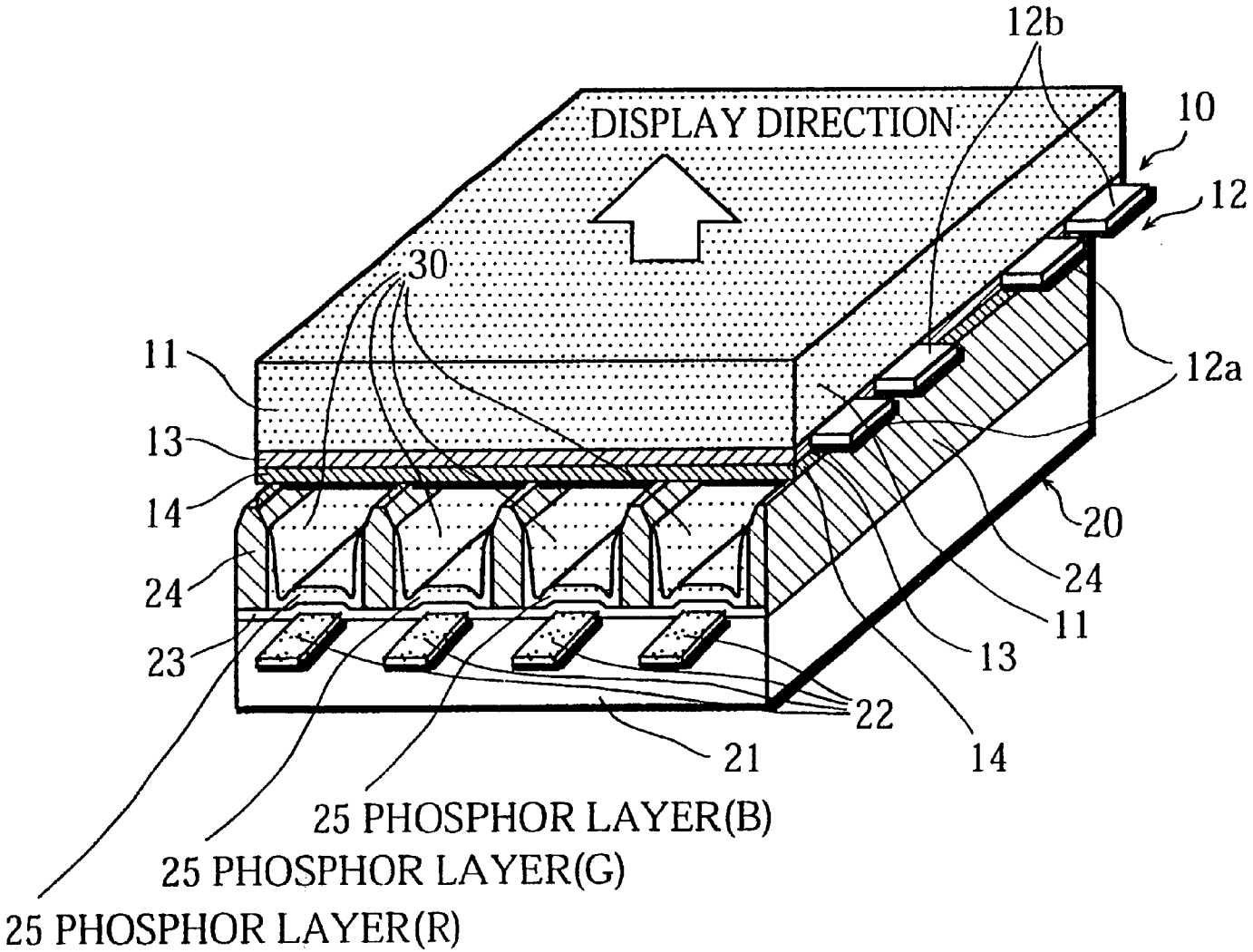
FIG. 1 is a cross-section of a PDP structure common to both of the embodiments in the present invention.

FIG. 1 is a cross-section showing the essential components of an AC PDP relating to the present embodiment. In the drawing, a part of the display area in the center of the PDP is shown.

This PDP is constructed from a front plate 10 and a back plate 20. The front plate 10 is formed from a front glass plate 11, on whose inward surface are placed discharge electrodes 12, formed of pairs of scanning electrodes 12*a* and sustaining electrodes 12*b*, a dielectric layer 13 and a protective layer 14. The back glass plate 20 is formed from a back glass plate 21, on whose inward surface are placed address electrodes 22 and a visible light reflective layer 23. The front plate 10 and the back plate 20 are arranged in parallel leaving a gap between them, with the discharge electrodes 12 and the address electrodes 22 facing each other. The space between the front plate 10 and the back plate 20 is divided into discharge spaces 30 by constructing partitions 24, which run in uniform parallel lines. A discharge gas is enclosed in these discharge spaces 30.

Additionally, a phosphor layer 25 composed of alternate red, green and blue phosphors is applied to the surface of the back plate 20 inside the discharge space 30.

The discharge electrodes 12 and the address electrodes 22 are both arranged in uniform parallel lines, the discharge electrodes 12 at right angles to the partitions 24, and the address electrodes 22 parallel with the partitions 24. The panel is of a structure in which the points where the discharge electrodes 12 and the address electrodes 22 intersect form cells emitting red, green and blue light.

The address electrodes 22 are metal electrodes, for example, silver electrodes or Cr—Cu—Cr (chromium-copper-chromium) electrodes. The discharge electrodes 12 may be constructed by laminating a wide transparent electrode made from an electrically conductive metal oxide such as ITO, $SnO_2$ or ZnO with a narrow bus electrode such as a silver electrode or a Cr—Cu—Cr electrode. This electrode structure is preferable since it keeps the resistance in the display electrodes low while securing a wide discharge area within cells. However, the discharge electrodes 12 may also be formed from silver electrodes in the same way as the address electrodes 22.

The dielectric layer 13 is formed from a dielectric substance which is applied so that it covers the entire surface of the front glass 11 on which the discharge electrodes 12 are arranged. Lead glass with a low melting point is typically used for this purpose, but bismuth glass with a low melting point or a laminate of these two types of glass may also be used.

The protective layer 14 is a thin film of magnesium oxide (MgO) covering the entire surface of the dielectric layer 13.

The visible light reflective layer 23 is formed from the same material as the dielectric layer 13, but $TiO_2$ particles are added to enable it to work as a visible light reflective layer as well as a dielectric.

The partitions 24 are composed of a glass material and are placed projecting out from on the visible light reflecting surface 23 of the back plate 20.

Here, the phosphor layer 25 is formed using the following phosphors:

| | |
|---|---|
| Blue phosphor: | $BaMgAl_{10}O_{17}$ : Eu |
| Green phosphor: | $Zn_2SiO_4$ : Mn |
| Red phosphor: | $Y_2O_3$ : Eu or $(Y_xGd_{1-x})$ : Eu. |

The composition of these phosphors is identical to that used in the related art. However, the heat deterioration experienced by the phosphors during manufacture is less than in the related art, resulting in better color luminosity.

In other words, when only the blue cells in a conventional PDP are ignited, the y chromaticity coordinate (CIE Color Coordinate System) for color luminosity is 0.085 or more, and the color temperature in a white balance without color adjustment is around 6000K. When only blue cells in the PDP of the present embodiment are ignited, however, the y chromaticity coordinate for color luminosity is less than 0.08, and may be reduced to less than 0.06, making a color temperature of around 7000K to 11000K possible in a white balance without color adjustment. By reducing the size of the y chromaticity coordinate for the blue cells, a PDP whose color reproduction band in the blue area is wide can be achieved. Experiments performed by this inventor and others have confirmed that a light spectrum for a blue phosphor that can achieve a color temperature of more than 6000K requires a peak wavelength of 455 nm or less. That is to say, if the peak wavelength is shifted to more than 455 nm, the color moves closer to green and color reproduction quality deteriorates. This light spectrum characteristic only applies when the blue phosphor is ignited.

The present embodiment uses specifications suitable for a 40 inch high-vision television, in which the thickness of the dielectric layer 13 is approximately 20 $\mu$m and that of protective layer 14 approximately 1.0 $\mu$m. The height of the partitions 24 is 0.1 to 0.15 mm, the partitions are spaced at intervals of 0.15 to 0.3 mm and the thickness of the phosphor layer 25 is 5 to 50 $\mu$m. The gas enclosed between the plates is a Ne-Xe type gas, of which Xe forms 5%, and the pressure inside the plates is set at 500 to 800 torr.

Figure 21:
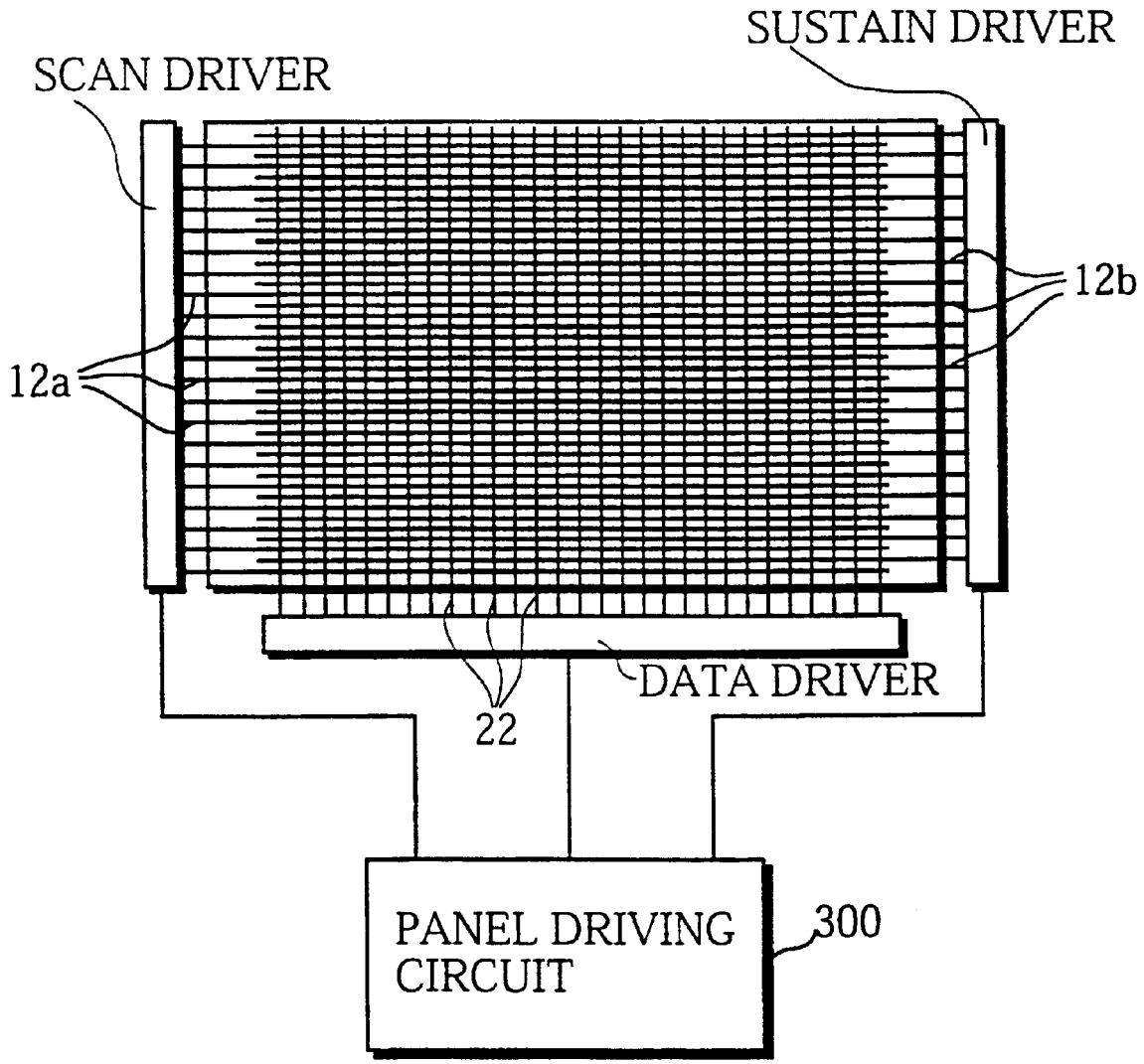
FIG. 21 shows various drivers and a panel driving circuit connected to the PDP.
Figure 22:
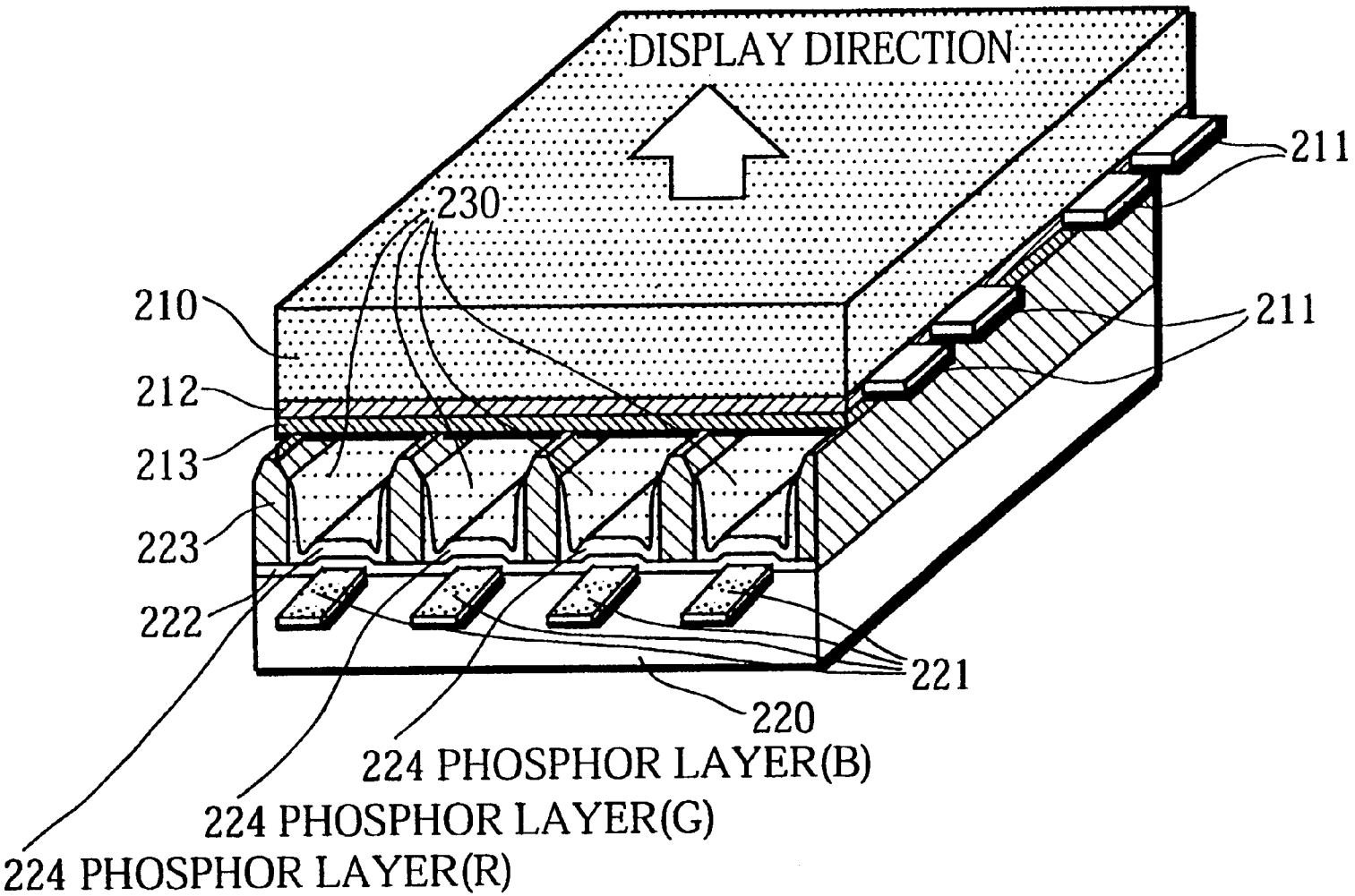
FIG. 22 shows a structure for a PDP in the related art.

When the PDP is driven, the PDP is attached to various drivers and a driving circuit 300, as shown in FIG. 21. Power is applied between the scanning electrode 12*a* and the address electrode 22 for the cell which is to be ignited creating a discharge. Following this, a pulse voltage is applied between the scanning electrode 12*a* and the address electrode 22 to create a sustaining discharge. Discharge in the cell is accompanied by the emission of ultra-violet light, which is converted into visible light by the phosphor layer 25. Igniting cells in this way enables images to be displayed.

Manufacturing Method for the PDP

The following is an explanation of a method used to manufacture a PDP with the above structure.

Manufacture of the Front Plate

The front plate 10 is manufactured in the following way. The discharge electrodes 12 are formed by applying a paste for forming transparent electrodes onto the front glass plate 11 and then a paste for silver electrodes on top of that using screen printing and baking the result. Then, a paste containing a lead glass material composed for example of 70% lead oxide (PbO) 15% boric acid ($B_2O_3$) and 15% silicon oxide ($SiO_2$), is applied using screen printing so as to cover this structure and then baked to form the dielectric layer 13. Finally, the protective layer 14 of magnesium oxide (MgO) is formed on the surface of the dielectric layer 13 using a chemical vapor deposition (CVD) method.

Manufacture of the Back Plate

The back plate 20 is manufactured in the following way. The address electrodes 22 are formed by screen printing a paste for silver electrodes on to the back glass plate 21 and then baking the result. A paste including $TiO_2$ particles and dielectric glass particles is applied on top of the address electrodes 22 using a screen printing method and the visible light reflective layer 23 formed by baking. Similarly, the partitions 24 are formed screen printing to repeatedly apply a paste including glass particles at fixed intervals, the result then being baked. At this time, a barrier should preferably also be formed on the back glass plate 21 surrounding the partitions 24 to block the flow of the sealing process. Formation of this barrier prevents the sealing glass from flowing towards the inside of the panel when it is being sealed.

The red, green and blue phosphor pastes are produced and applied to the gaps between the partitions 24 using screen printing and the phosphor layer 25 is formed by baking in air.

The phosphor pastes used here are produced in the following way.

To form the blue phosphor ($BaMgAI_{10}O_{17}$:Eu) barium carbonate ($BaCC_3$), magnesium carbonate ($MgCO_3$) and aluminum carbonate ($\alpha$—$Al_2O_3$) are combined so that the atomic ratio of Ba, Mg and Al is 1:1:10.

Next, a certain amount of europium oxide ($Eu_2O_3$) is added to the mixture and it is combined with an appropriate amount of a flux ($AlF_2$, $BaCl_2$) in a ball mill, and then baked in a deoxidized atmosphere ($H_2$ or $N_2$) at a temperature of between 1400° C. to 1650° C. for a certain time, for example 30 minutes, to produce the blue phosphor.

For the red phosphor ($Y_2O_3$:Eu) a certain amount of europium oxide ($Eu_2O_3$) is added to yttrium hydroxide $Y_2(OH)_3$ and mixed with an appropriate amount of the flux in the ball mill. The resulting mixture is baked in air at a temperature of between 1200° C. to 1450° C. for a certain time, for example one hour, to obtain the red phosphor.

In the case of the green phosphor ($Zn_2SiO_4$:Mn), zinc oxide (ZnO) and silicon oxide ($SiO_2$) are combined so that the atomic ratio of Zn and Si is 2:1. Next, a certain amount of manganese oxide ($Mn_2O_3$) is added to this mixture and it is mixed in the ball mill. The resulting mixture is baked in air at a temperature of between 1200° C. to 1350° C. for a certain time, for example 30 minutes, to obtain the green phosphor.

Phosphor particles produced using the above methods are pulverized and then sieved, to obtain phosphorous materials with a certain particle size distribution. The phosphors for the respective colors are then mixed with a binder or solvent to obtain pastes.

The phosphor layer 25 may also be formed using methods other than the above screening printing method. For example, a method in which phosphor ink is squirted from a nozzle which is being scanned over the panel may be used. Alternately, photosensitive sheets of resin having phosphors for each color may be produced, and fixed to the face of the back glass plate 21 on which the partitions 24 are arranged. The sheets of resin are then patterned and exposed using photolithography to eliminate unnecessary components.

Sealing of the Front and Back Plates

Sealing glass (a glass frit) is applied to one or both of a front plate 10 and back plate 20 manufactured as described above, and pre-baking takes place to form a sealing glass layer. The plates are placed against each other with the discharge electrodes 12 on the front plate 10 and the address electrodes 22 on the back plate 20 at right angles. Both plates are heated, softening the sealing glass layer and sealing them together.

Then, gas is temporarily removed from the space between the sealed plates by baking the panel while its interior is evacuated. Then a discharge gas is encased in this space.

The following is a detailed explanation of the pre-baking and sealing processes.

Figure 2:
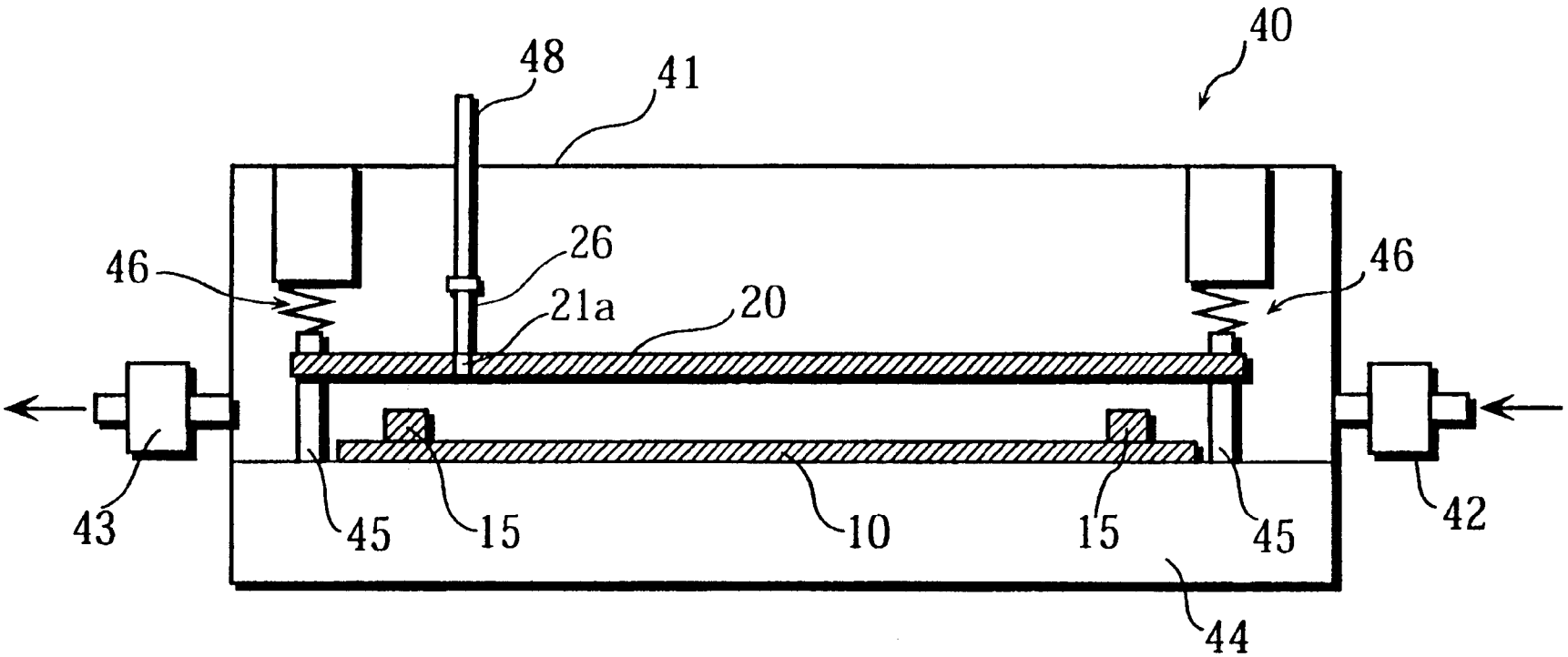
FIG. 2 is a top-view of a structure for a sealing device relating to a first embodiment.

FIG. 2 shows a structure for a sealing device used in the pre-baking and sealing processes.

The sealing device 40 includes an oven 41 to which a gas feeder valve 42 and a gas exhaust valve 43 are attached. The oven 41 heats the front plate 10 and the back plate 20. The gas feeder valve 42 regulates the amount of atmospheric gas introduced inside the oven 41. The exhaust valve 43 regulates the amount of gas evacuated from inside the oven 41.

The oven 41 is capable of heating materials at high temperatures using a heater (not shown). An atmospheric gas, for example dry air containing steam at a partial pressure of around 20 torr, which forms the atmosphere in which the front and back plates are heated is introduced inside the oven 41 via the gas feeder valve 42, and evacuated via the gas exhaust valve 43 using a vacuum pump (not shown) to create a high vacuum inside the oven 41. The vacuum inside the oven 41 can thus be regulated by the gas feeder valve 42 and the gas exhaust valve 43. From hereon, the expressions 'dry gas' and 'dry air' will be understood to mean gas and air that have a steam pressure of 20 torr or less (a vaporization point of 22° C. or less).

A gas drying device is located between the atmospheric gas supply source and the oven 41. This gas drying device cools the atmospheric gas to a low temperature of minus several dozen degrees, condensing it to eliminate moisture. As a result, the amount of steam (partial pressure of steam) in the atmospheric gas can be controlled.

A platform 44 for aligning and supporting the front plate 10 and the back plate 20 is provided inside the oven 41. Pins 45 which move the back plate while keeping it level, are installed on the upper surface of the platform 44. Pressing mechanisms 46 are provided above the platform 44 to press the back plate 20 downwards.

An air vent 21*a* is formed near the edge of the back glass plate 21. A glass tube 26 is attached to the air vent 21*a*, and this glass tube 26 is in turn connected to a pipe 48 that has been inserted into the oven from outside.

Figure 3:
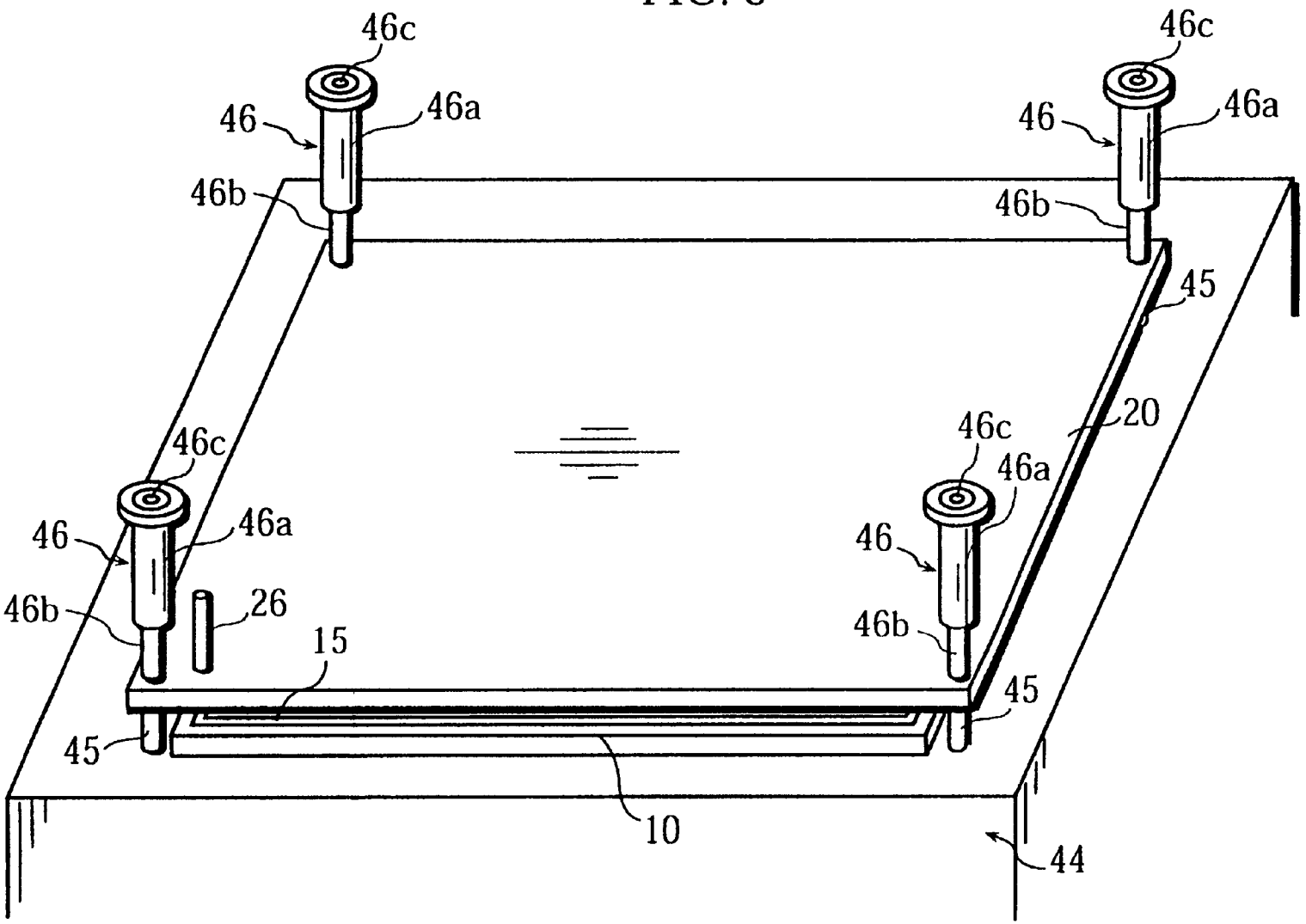
FIG. 3 is a view of an internal structure of the sealing device.

FIG. 3 shows a view of the interior of the oven 41.

In FIGS. 2 and 3, the back plate 20 is arranged so that the lines of partitions are parallel with the horizontal plane in the drawings.

The back plate 20 is set so that it is somewhat longer horizontally than the front plate 10, and protrudes from either side of the front plate 10, as shown in FIGS. 2 and 3. (An extension line is placed in this protruding section to connect the address electrodes 22 to the driving circuit). The pins 45 and the pressing mechanisms 46 are arranged so that they grip the protruding part of the back plate 20 from above and below at each of the four corners.

The upper ends of the four pins 45 protrude upwards from the upper surface of the platform 44, and are moved up and down simultaneously by a pin adjustment mechanism (not shown) fitted inside the platform 44.

Each of the four pressing mechanisms 46 is constructed from a cylindrical holder 46*a*, a slide 46*b* and a spring 46*c*. The holder 46*a* is fixed to the roof of the oven. The slide 46*b* is inserted into the holder 46*a* so that it is free to move up and down. The spring 46*c* inside the holder 46*a* applies an opposing force to the lower end of the slider 46*b*, causing it to press down on the back plate 20.

Figure 4A:
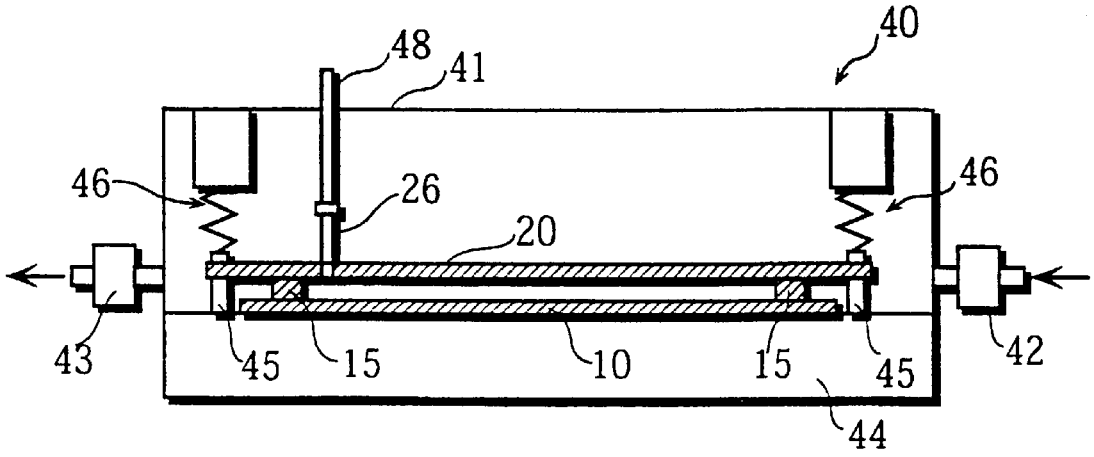
FIG. 4, A to C show the operation of a preliminary heating process and a sealing process using the attachment device.
Figure 4B:
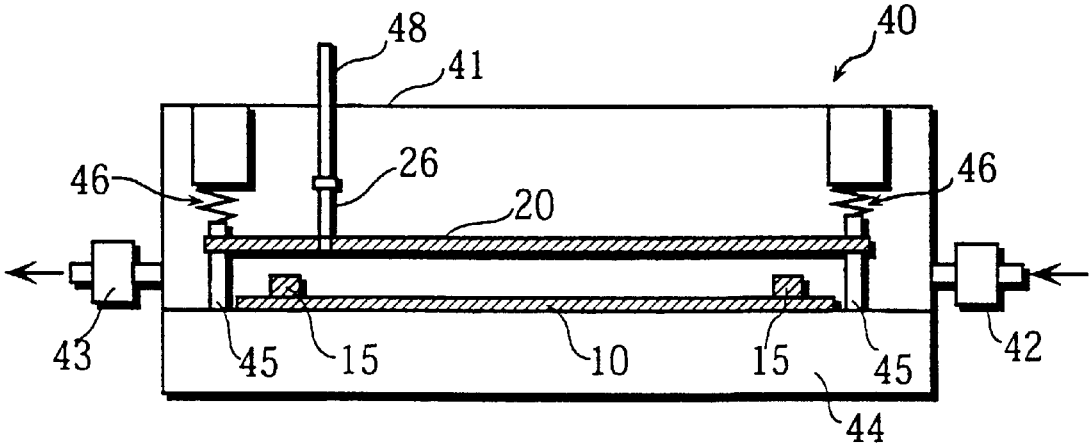
Figure 4C:
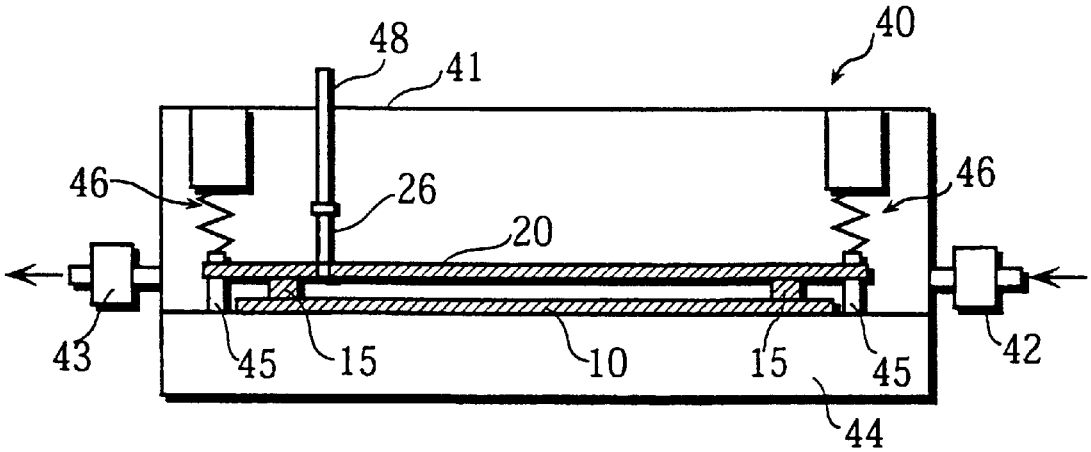

FIG. 4 shows the operations performed for the preliminary heating process and the sealing process using the sealing device.

The pre-baking process, the preliminary heating process and the sealing process will now be explained with reference to the drawings.

Pre-baking Process

In this process, a glass attachment layer 15 is formed around the edge of the surface of the front plate 10 facing the back plate 20, the edge of the surface of the back plate 20 facing the front plate 10, or the edges of the facing surfaces of both the front plate 10 and the back plate 20, by applying a sealing glass paste. In the drawings, the sealing glass layer 15 is formed on the surface of the front plate 10.

The front plate 10 and the back plate 20 are placed together in alignment before being positioned on the prescribed area of the platform 44. Then the pressing mechanisms 46 are set to press down the back plate 20 (See FIG. 4, A).

Next, the following operations are performed while atmospheric gas (dry air) is being circulated through the oven 41 (or while the vacuum is being created by evacuation from the gas exhaust valve 43).

The pins 45 are raised, lifting up the back plate 20 in an even motion (See FIG. 4, B). This widens the gap between the front plate 10 and the back plate 20 and exposes the surface of the back plate 20 on which the phosphor layer 25 to the gas inside the oven 41.

The inside of the oven 41 is heated to a pre-baking temperature of around 350° C. with the plates still in this position, and pre-baking takes place by keeping the oven 41 at this temperature for between 10 to 30 minutes.

Preliminary Heating Process

The plates 10 and 20 are heated to a higher temperature to release the gas that they have absorbed. When a certain temperature, for example 400° C., is reached, the preliminary heating process is terminated.

Sealing Process

Next, the pins 45 are lowered so that the back plate 20 is once more fitted against the front plate 10, with the back plate positioned just as it was originally (See FIG. 4, C).

When the temperature inside the oven 41 has reached a sealing temperature higher than the softening point of the sealing glass layer 15 (around 450° C.), this temperature is maintained for between 10 to 20 minutes. Here, the edges of the front plate 10 and the back plate 20 are sealed by the softened sealing glass. Meanwhile, the back plate 20 is pressed down onto the front plate 10 by the pressing mechanisms 46, ensuring that the plates are sealed in a controlled manner.

The sealing method used in the present embodiment differs from the sealing method used in the related art by demonstrating the following effects.

Normally, steam or other gas has been absorbed by the front plate and the back plate, but the absorbed gas can be released by heating the plates.

In a manufacturing method commonly used in the related art, the sealing process is performed by fitting the front and back plates together at room temperature after the passages 67, so this structure does not impede the circulation of the gas at all. Pre-baking process has been performed, and then heating them to seal them together. This means that the gas that has been absorbed by the plates is released during the sealing process. A certain amount of the gas absorbed by the plates is released during the pre-baking process. However, since the plates are kept in atmospheric conditions at room temperature until the start of the sealing process gas is once more be absorbed, and this gas is released during the sealing process. The released gas is trapped in the narrow space between the plates. Measurements have shown that the partial pressure of steam in this space regularly reaches 20 torr or more.

As a result, the phosphor layer 25 inside this space is prone to heat deterioration caused by gas (particularly steam released by the protective layer 14). If the phosphor layer 25 (in particular the blue phosphor) experiences heat deterioration, its luminous intensity will be reduced.

In contrast, in the manufacturing method used in the present embodiment, steam and the like which has been absorbed by the front and back plates 10 and 20 is released during the sealing process and the preliminary heating process, but the gas generated is not trapped in the space between the plates as the gap between them has been made wider. After the preliminary heating has been completed, the plates 10 and 20 are sealed together while still hot, and so moisture and the like is not absorbed by the plates after the end of the preliminary heating process. Thus, the amount of gas generated by plates 10 and 20 during the sealing process is reduced, and heat deterioration of the phosphor layer 25 prevented.

In the present embodiment, the part of the manufacturing process from the preliminary heating process to the sealing process is performed in an atmosphere through which dry air is circulated, so that heat deterioration of the phosphor layer 25 caused by steam contained in the atmospheric gas does not occur.

Furthermore, use of the sealing device 40 enables the front plate 10 and the back plate 20 to be aligned and then sealed while still in this aligned position.

Next, the panel is cooled and removed from the oven 41. A driving circuit or similar used in the aging process is connected to the discharge electrodes, and the aging process is performed to stabilize the luminous intensity and discharge characteristics.

Figure 5:
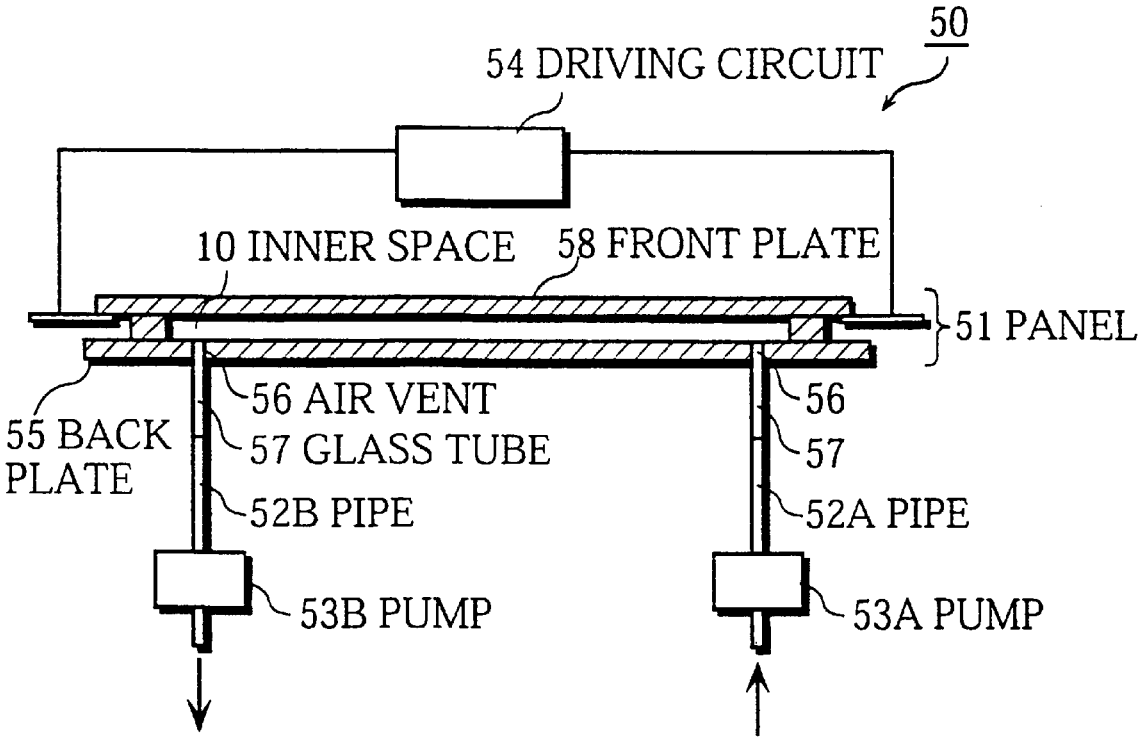
FIG. 5 is a top-view of a structure for an aging device relating to the first embodiment.

FIG. 5 shows a structure of an aging device 50 for performing the aging process in the present embodiment. The aging device 50 is constructed from pipes 52*a* and 52*b*, valves 53*a* and 53*b* and a driving circuit 54. The pipes 52*a* and 52*b* circulate a discharge gas through the inside of a panel 51. The valves 53*a* and 53*b* regulate the pressure of the discharge gas inside the panel 51. The driving circuit 54 is used to apply a voltage as a pulse.

A back plate 55 is formed from address electrodes, a visible light reflective layer and partitions. Two or more air vents 56 are formed in the non-display area of the back plate 55 to allow passage to the inside of the panel. These air vents 56 include the air vent 21*a* and other, newly-formed, air vents. A glass tube 57 is attached to each of these air vents and the back plate 55 is placed on a platform (not shown). Then the glass tubes 57 are connected to the pipes 52*a* and 52*b* used for circulating the discharge gas. Next, after a vacuum is formed inside the panel 51 using the pipe 52*a*, a discharge gas 58 is introduced using the pipe 52*b*. The valves 53*a* and 53*b* are then adjusted so that the discharge gas will continue to flow at a certain flow rate while being maintained at a certain pressure. It is desirable that the gas flow rate be kept at a uniform level, since fluctuations in the flow rate cause the discharge voltage to fluctuate. This kind of situation can be avoided altogether by estimating the fluctuation rate in advance and applying a discharge voltage generous enough to cover any variations.

When the air vents 56 are formed in two places as in the drawing, they should be positioned in diagonally opposite corners of the back plate 55, with the partition walls running vertically between them. This kind of positioning enables the gas introduced inside the panel to flow in a satisfactory manner.

In the present invention, a dry inert gas such as He, Ne, Ar or Xe, or a mixture of the above, is circulated through the space inside the panel as the discharge gas, and the discharge gas pressure is set at a level of 100 to 760 torr.

After the gas pressure is regulated, a certain voltage is applied to the discharge electrodes formed in the front plate 58 using the driving circuit 54, while the gas is still circulating through the inside of the panel. This generates a discharge inside the panel 51, which is then aged for a certain time.

By continuing to produce a discharge while circulating the discharge gas inside the panel 51, gas, including steam generated inside the panel, can be evacuated, and the deterioration in the luminescence characteristics of the phosphor layer generated during aging in the related art is reduced.

In addition, dry gas is used as the discharge gas introduced inside the panel, reducing the heat deterioration created when the phosphor layer comes into contact with steam contained in the discharge gas.

To achieve the above effects, it is vital that gas generated within the extremely narrow passages formed by the partitions inside panel 51 be released efficiently during the aging process. The discharge gas introduced thus needs to be able to flow evenly through the passages formed by the partitions. FIGS. 6 to 12 show various panel structures which achieve this effect. The partitions run in uniform parallel lines across the whole surface of the panel, but FIGS. 6 to 12 shows only a number of these lines on either side of the panel.

Figure 6:
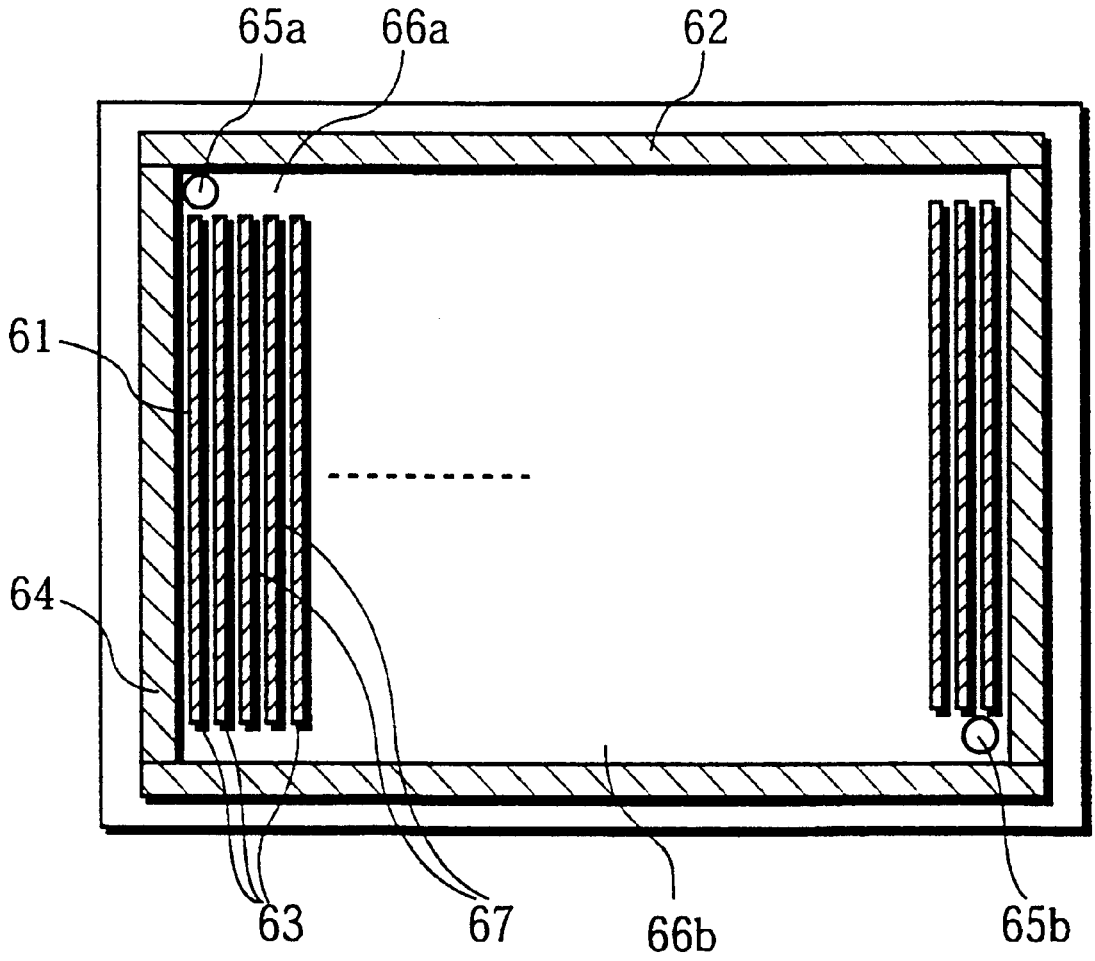
FIG. 6 is a top-view showing the relative placement of partitions, sealing glass and air vents on a back plate.
Figure 7:
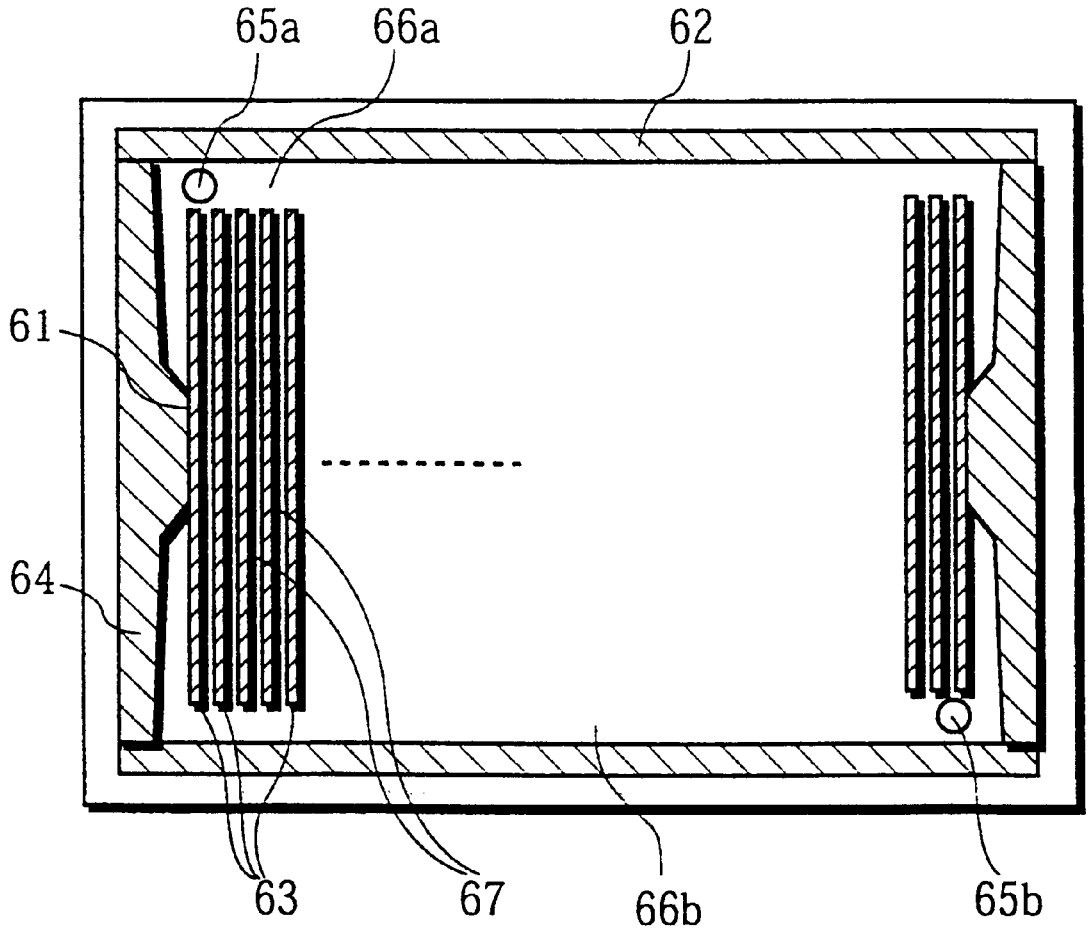
FIG. 7 is a top-view showing the relative placement of partitions, sealing glass and air vents on a back plate.

FIG. 6 shows a panel having a structure in which the shortest space between a sealing glass layer 62, running at right angles to partitions 61, and partition ends 63 is wider than the shortest space between a sealing glass layer 64, running parallel to the partitions 61, and a neighboring partition 61. The discharge gas introduced from an air vent 65*a* spreads out in the area 66*a* formed above the ends of the partitions, flows evenly into the passages 67 between the partitions and is then evacuated from an air vent 65*b* located in a space 66*b* formed below the ends of the partitions. (Note that the terms 'above' and 'below' only apply to the view of the panel shown in the drawing) Gas generated inside the panel can be evacuated efficiently, reducing the phosphor deterioration experienced during the aging process.

In this structure, the difference between the shortest space between sealing glass layers 62 and partition ends 63 and the shortest space between sealing glass layers 64 and a neighboring partition 61, is widened. This enables the gas to flow more evenly through the passages 67 between the partitions, because the gas introduced from the air vent 65*a*, spreads out in the space 66*a* in the vicinity of the air vent 65*a*, and can thus be easily distributed into each of the passages 67 and evacuated from the passages 67. Here, a structure like that shown in FIG. 7, in which at least one part of the sealing glass layer 64 running parallel to the partitions is connected to the nearest partition, is the most effective. This is because discharge is not created outside the partitions on either side of the panel, and so there is no need for gas to flow into this part. If the flow of gas into this part of the panel can be interrupted, the flow of gas in and out of the discharge areas where discharge is created during the aging process can be performed more efficiently.

The distance between the ends of the partitions and the sealing glass layer bordering on 66*a* is a concern only for the part of the panel interior near to the air vent 65*a* from which the gas enters. If the partition end 63 which is furthest away from the air vent 65*a* touches the sealing glass layer 62, the gas introduced via the air vent 65*a* into the space 66*a* is still distributed to the passages 67, so this structure does not impede the circulation of the gas at all. In other words, if the part of the panel near to the air vent 65*a* is narrow, the gas will instead disperse into a wider space where it can circulate more easily, and it will not be possible to distribute the gas effectively to the passages 67. From hereon, any mention of the distance between the partition ends bordering on the space 66*a* and the sealing glass layer (or the barrier) will refer to the distance relating to partition ends other than that furthest away from the air vent into which the gas is introduced.

Similarly, the distance between the ends of the partitions and the sealing glass layer bordering on space 66*b* is a concern only for the part of the panel interior near to the air vent 65*b* from which the gas enters. If the partition end 63 which is furthest away from the air vent 65*a* touches the sealing glass layer 62, the gas introduced via the air vent 65*a* into the space 66*b* is still distributed to the In other words, if the part of the panel near to the air vent 65*b* is narrow, the gas will instead disperse into a wider space where it can circulate more easily, and it will not be possible to distribute the gas effectively to the passages 67. From hereon, any mention of the distance between the partition ends bordering on the space 66*b* and the sealing glass layer (or the barrier) will refer to the distance relating to partition ends other than that furthest away from the air vent into which the gas is introduced.

If the gap between the partition ends and the sealing glass layer in the space 66*b* from which the gas is evacuated is narrow it becomes more difficult to evacuate the gas flowing from the passages 67 from the air vent 65*b* after it has passed through the space 66*b*. However, the efficiency of gas distribution to the passages 67 may still be improved by widening the distance between the partition ends 63 and sealing glass layer 62 bordering on the space 66*a* as specified above. Of course, if the space 66*b* is widened greater efficiency in evacuating gas from the passages 67 to the space 66*b* can be achieved. Therefore, the flow of gas through the passages 67 can be achieved more efficiently by determining the gap between partition ends and sealing glass layer, as described above, for both 66*a* and 66*b*.

Figure 8:
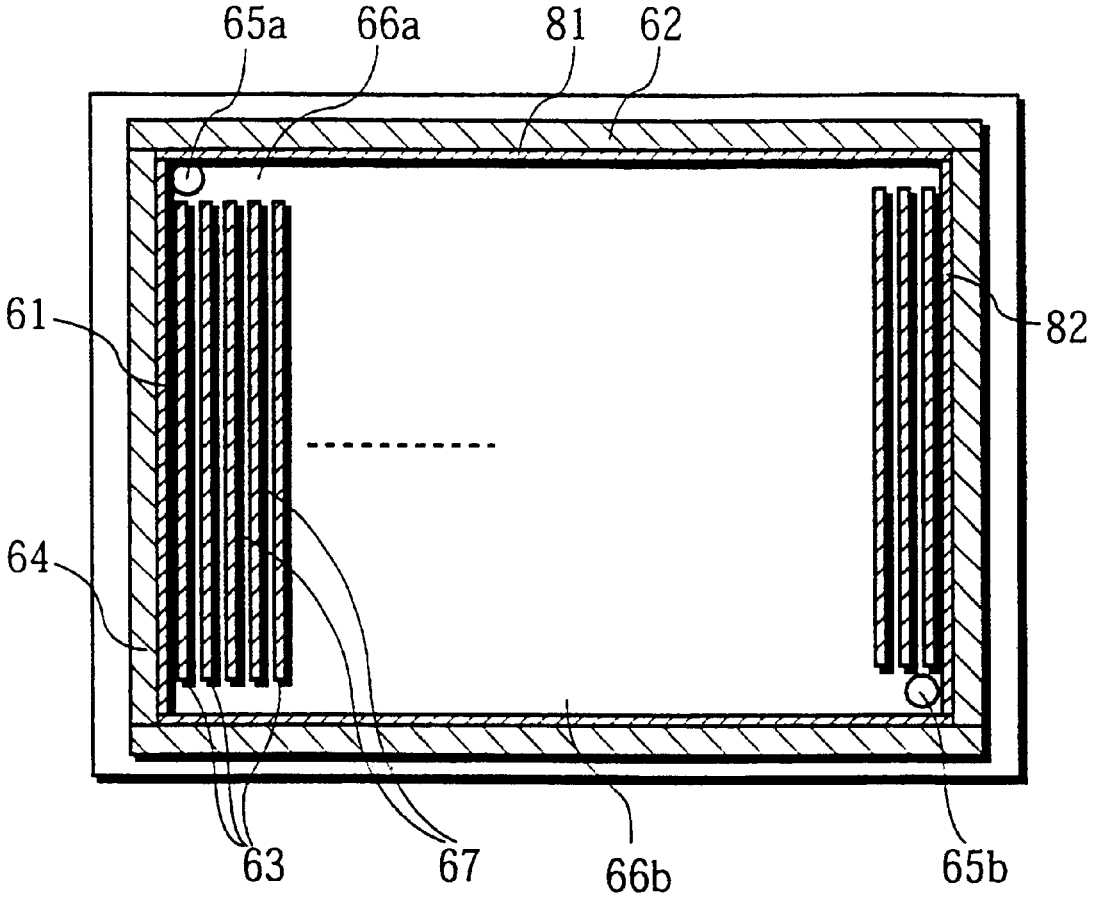
FIG. 8 is a top-view showing the relative placement of partitions, sealing glass and air vents on a back plate.
Figure 9:
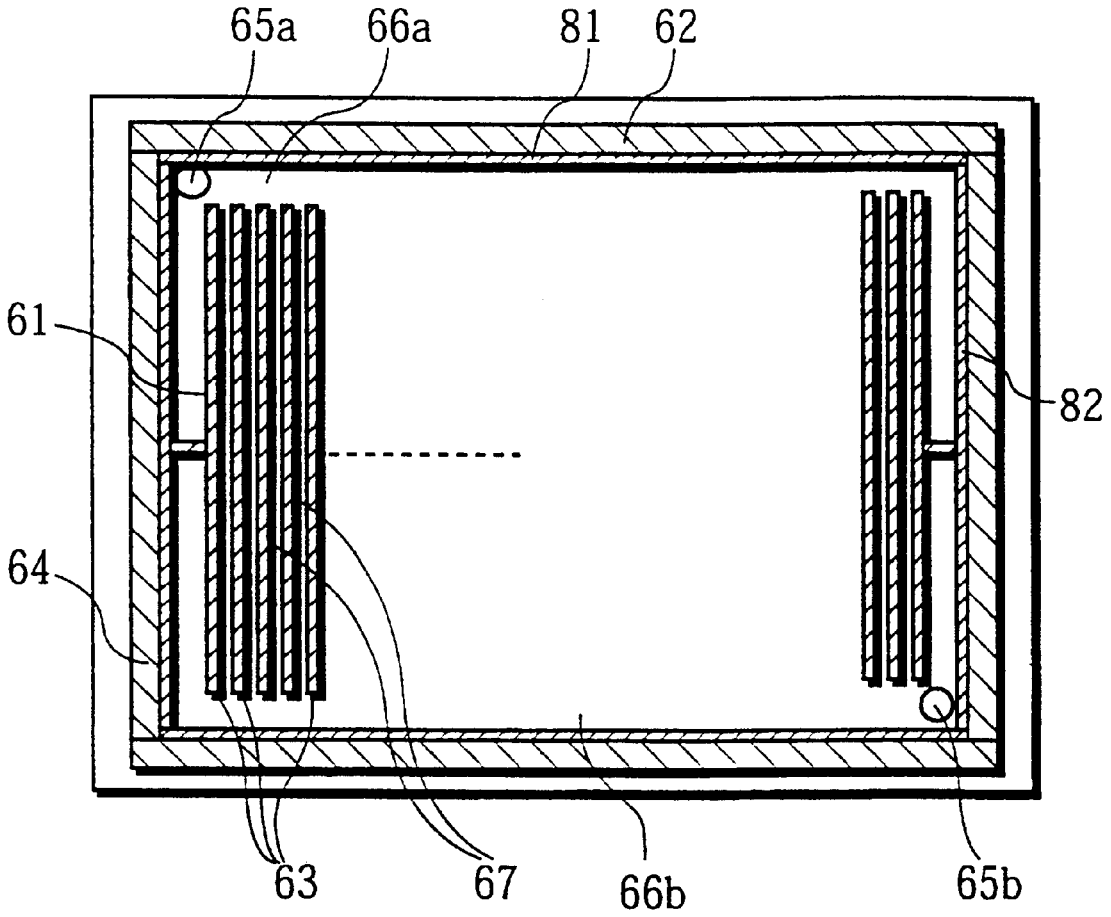
FIG. 9 is a top-view showing the relative placement of partitions, sealing glass and air vents on a back plate.

FIG. 8 shows a structure for a panel in which barriers 81 and 82 are formed between the sealing glass layers 62 and 64 and the lines of partitions. The barriers 81 and 82 prevent the sealing glass layers 62 and 64 from flowing inside the panel when sealing takes place. The shortest distance between the barrier 81, running at right angles to the partitions 61, and the partition ends 63 is wider than the shortest distance between the barrier 82, running parallel to the partitions 61, and the neighboring partition 61. The discharge gas introduced from the air vent 65*a* spreads out in the area 66*a* formed above the ends of the partitions, flows evenly through the passages 67 between the partitions and is then evacuated from the air vent 65*b* after passing through a space 66*b* formed below the ends of the partitions. (Note that the terms 'above' and 'below' only apply to the view of the panel shown in the drawing) Gas generated inside the panel can be evacuated efficiently, reducing the phosphor deterioration experienced during the aging process.

In this structure, the difference between the shortest space between the barrier 81 and partition ends 63, and the shortest space between the barrier 82 and a neighboring partition 61 is widened. This enables the gas to flow more evenly through the passages 67 between the partitions. Here, a structure like that shown in FIG. 9, in which at least one part of each of the barriers 82 running parallel to the partitions is in contact with the nearest partition 61, is the most effective. This is because discharge is not created outside of the partitions on either side of the panel, and so there is no need for gas to flow into this part. If the flow of gas into this part of the panel can be interrupted, the flow of gas in and out of the discharge areas where discharge is created during aging can be performed more efficiently.

Figure 10:
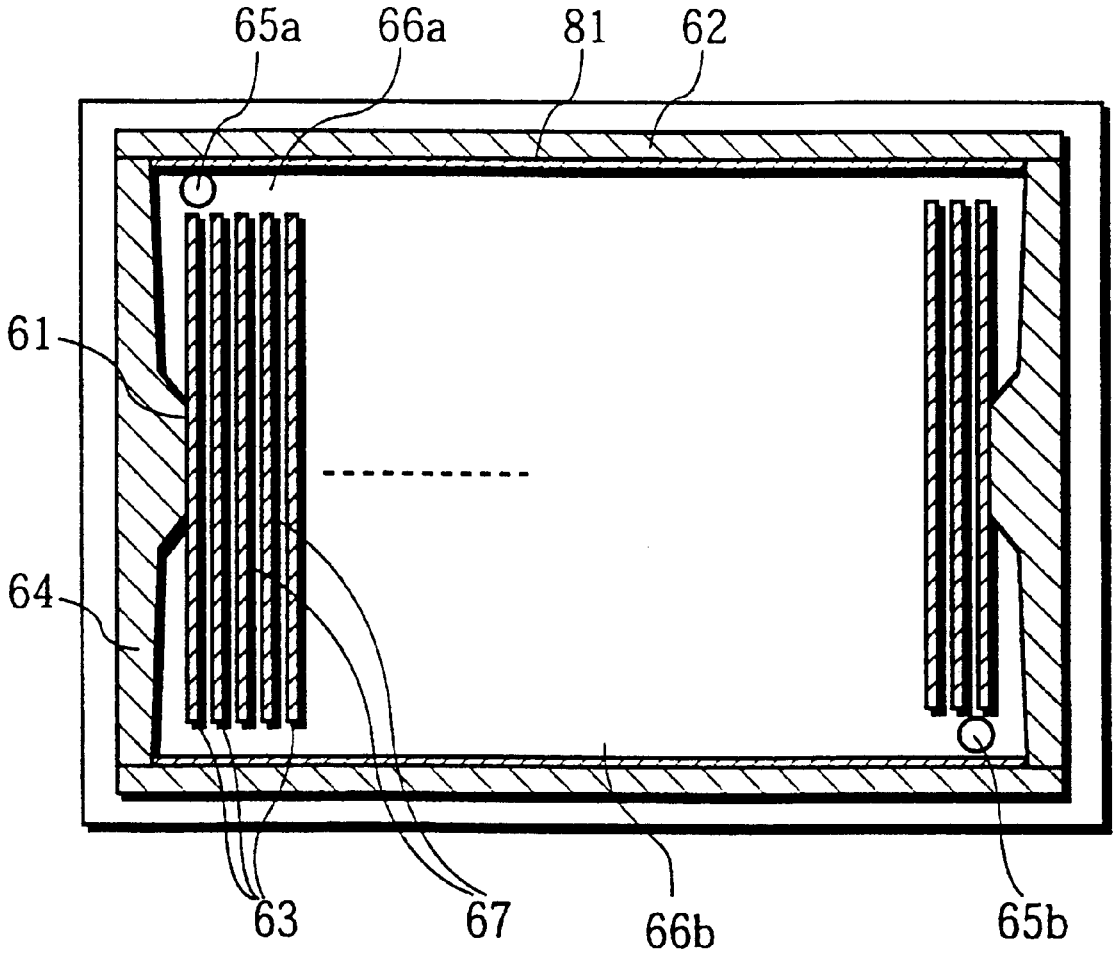
FIG. 10 is a top-view showing the relative placement of partitions, sealing glass and air vents on a back plate.

Alternatively, the same effect may be obtained by a panel constructed as shown in FIG. 10. Here, only the barriers 81 running at right angles to the partitions 61 are formed, and the partitions 61 and the sealing glass layer 64 are connected.

Figure 11:
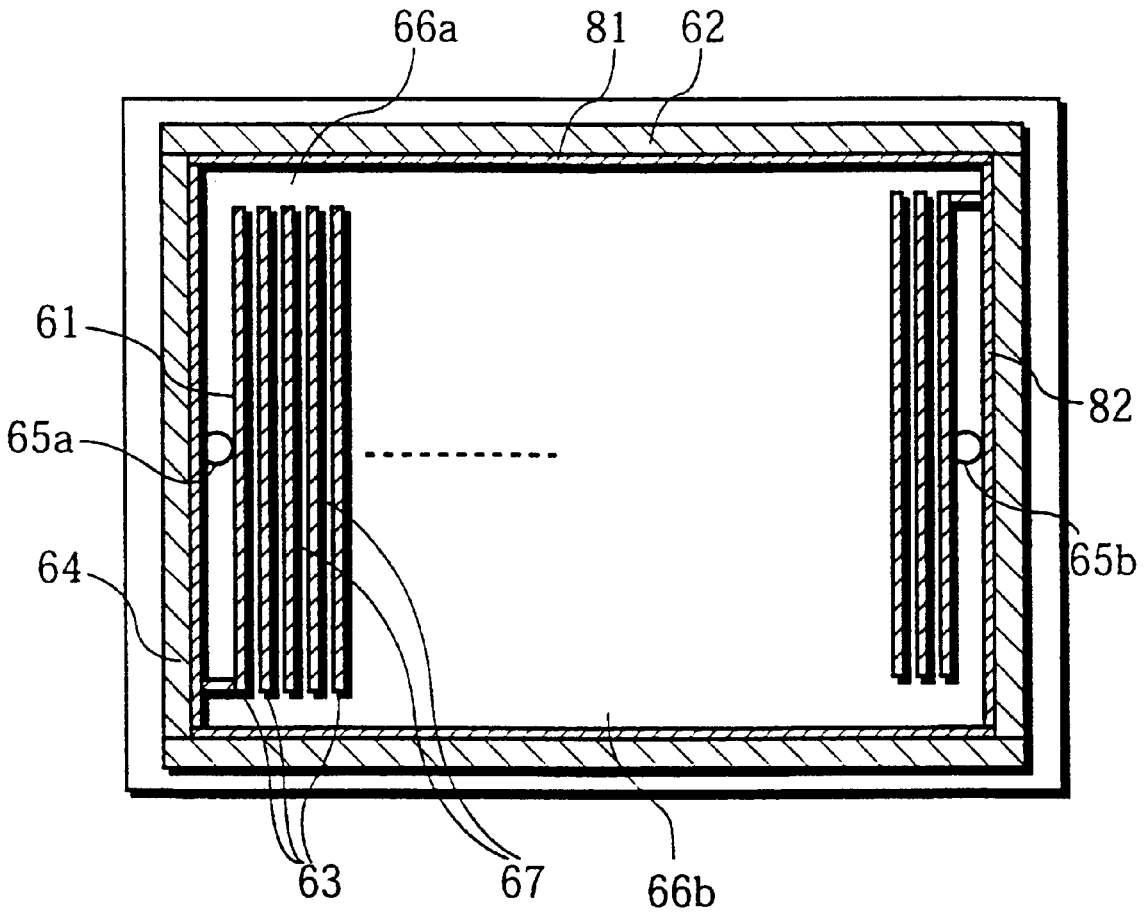
FIG. 11 is a top-view showing the relative placement of partitions, sealing glass and air vents on a back plate.

The position of the air vents 65*a* and 65*b* need not be limited to above and below the partition ends. The air vents 65*a* and 65*b* may be placed adjacent to the midsection of the partitions 61, as shown in FIG. 11. Here, the partition 61 and the barrier 82 located on either side of the air vents 65*a* and 65*b* may be connected as shown, limiting the circulation of gas to a one-way flow and enabling the introduction of gas into the passages to be performed more effectively.

Figure 12:
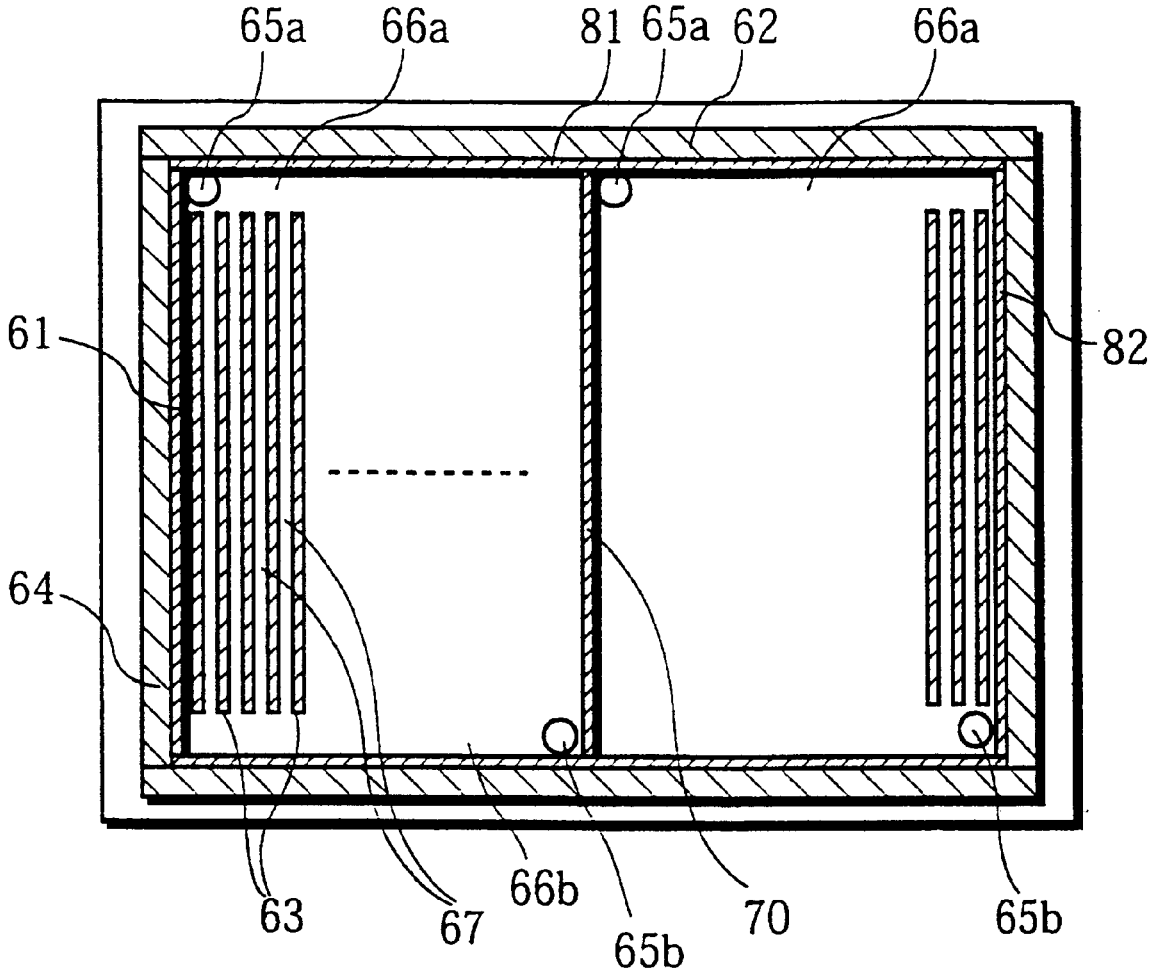
FIG. 12 is a top-view showing the relative placement of partitions, sealing glass and air vents on a back plate.

As long as gas can be introduced and evacuated the number of air vents need not be limited to two, and a larger number may be used. The panel may be divided by a partition 83, and the introduction and evacuation of gas regulated separately in each part, as shown in FIG. 12.

After aging has been performed, the panel is returned to the oven 41, the temperature lowered to an evacuation temperature lower than the softening point of the sealing glass, for example around 350° C. This evacuation temperature is sustained for one hour, and the panel heated while gas is removed from between the plates by evacuating until a high vacuum of $8\times10^{-7}$ torr is reached. This evacuation process takes place by connecting a vacuum pump (not shown) to the pipe 48. Only one of the air vents connected to the pipe needs to be open however, and the remaining air vents are closed so that they do not release gas into the panel.

After this evacuation process the PDP is manufactured in the following way. First, the panel is cooled to room temperature with the space between the plates kept as a vacuum. Then a discharge gas is introduced into the space between the plates through the open glass tube. All of the air vents are then sealed and the glass tubes removed.

By performing the aging process as described above, the heat deterioration of the phosphors that was unavoidable in the aging process used in the related art can be reduced. The reasons for this are examined below.

Figure 13:
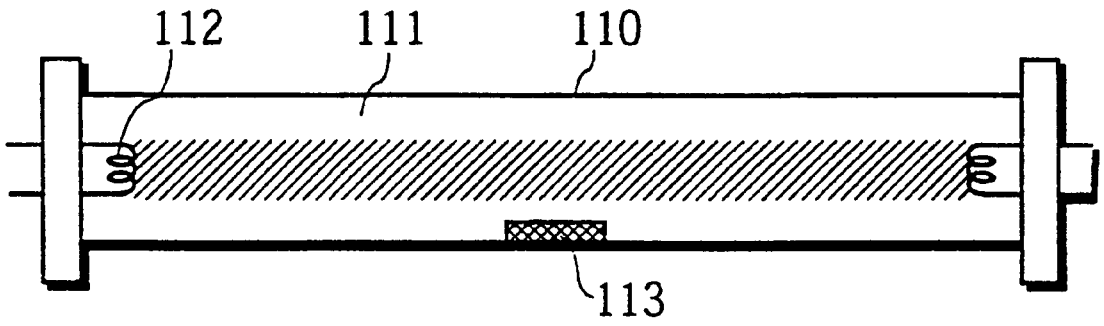
FIG. 13 is a top-view showing a structure for a discharge tube assessing the durability of the phosphor layer.

Firstly, the ability of the blue phosphor used ($BaMgAl_{10}O_{17}$:Eu) to withstand electric discharge was evaluated using a device like the one shown in FIG. 13.

This assessment device evaluates the luminescence 1.5 characteristics of the phosphor before and after the application of an electric discharge for a certain time. First, a quantity of the corresponding phosphor was applied to the inner surface of a discharge tube 110. A discharge gas 111 was introduced inside the discharge tube 110 at a certain pressure, and a discharge created by applying voltage between a pair of electrodes 112. The discharge gas 111 was a mixture of Ne, Xe and steam and the gas pressure was set at 100 torr. The ratio of Ne and Xe was fixed at 95:5, and evaluation of the luminescence characteristics of the phosphor was performed by varying the amount of steam (or the vaporization point). A heat eliminator 113, in this case BaO, was placed inside the discharge tube 110 to eliminate heat generated inside the tube.

Figure 14:
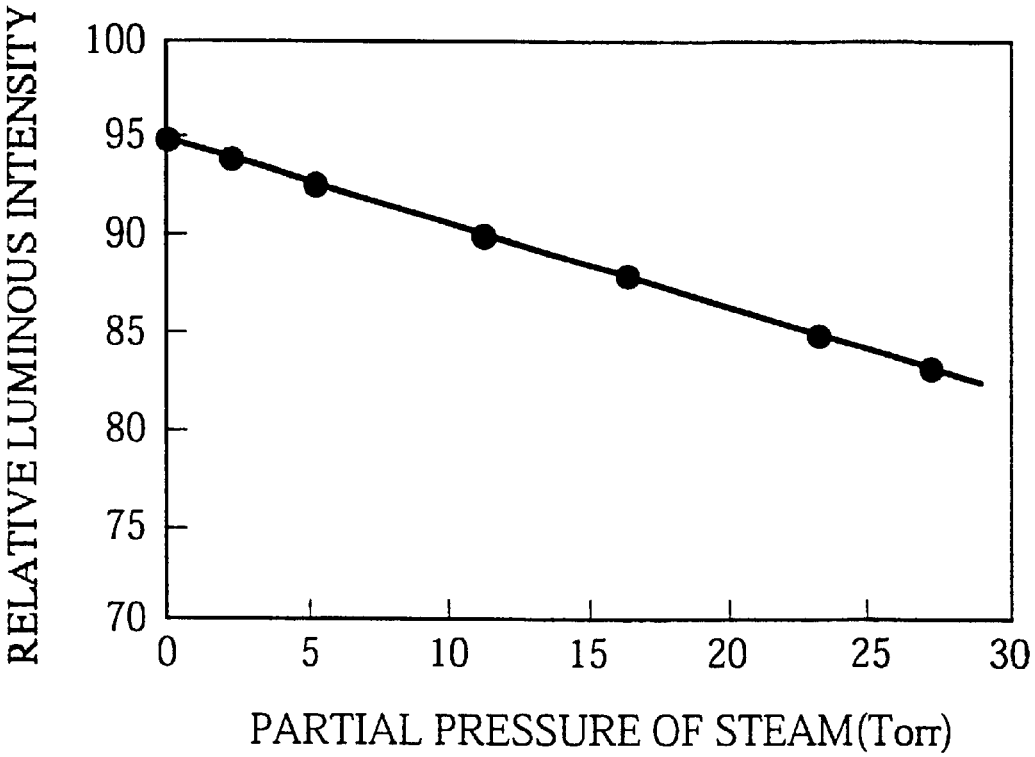
FIG. 14 is a graph showing the relation between luminous intensity of the phosphors and partial pressure of steam.
Figure 15:
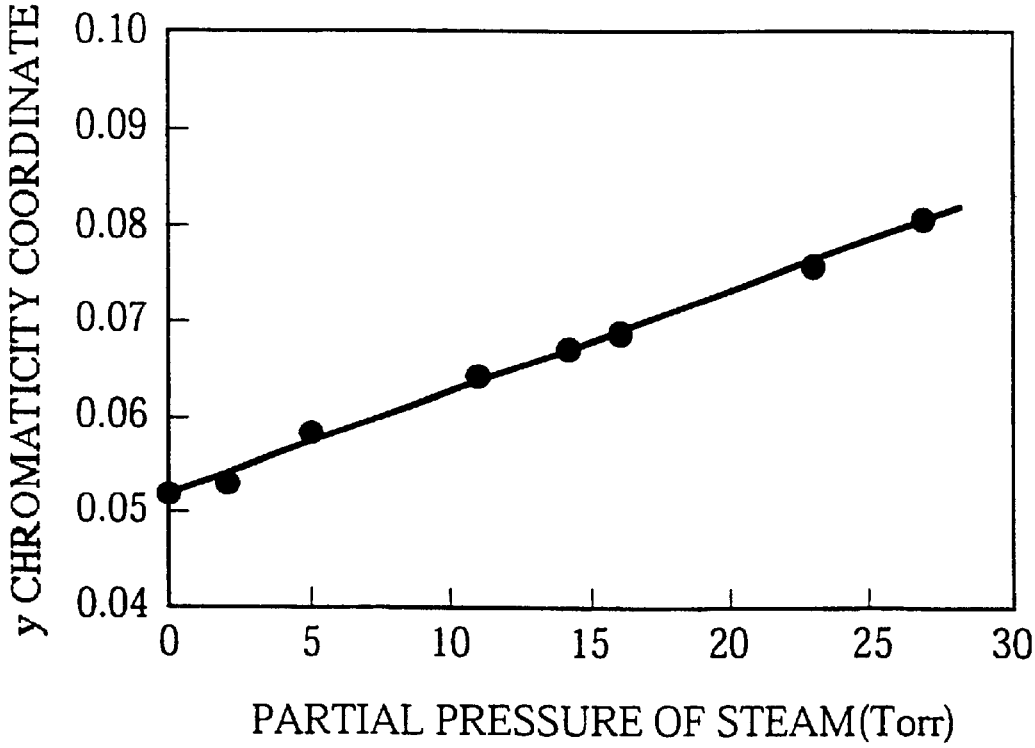
FIG. 15 is a graph showing the relation between a y chromaticity value for the phosphors and partial pressure of steam.

FIG. 14 shows the rate of variation in luminous intensity resulting from discharge (luminosity before and after the discharge) and FIG. 15 results measuring the y chromaticity value after the discharge. Both sets of results apply to the blue phosphor used ($BaMgAl_{10}O_{17}$:Eu). The horizontal axis in both drawings shows the partial pressure of steam contained in the discharge gas.

The y chromaticity value of the blue phosphor before the experiment commenced was 0.052.

The luminous intensity after the discharge grew weaker as the partial pressure of the steam was increased. When the partial pressure of the steam was in the region of 0 torr, no variation in chromaticity caused by the discharge was observed, but variations in chromaticity increased along with the partial pressure of the steam. Such increases in the y value of the blue phosphor will cause the color reproduction band width of the panel to become narrower. If the deterioration in luminous intensity after discharge is inferred from the change in the y value however, it is larger than the value for deterioration caused only by heating the panel in steam.

Consequently, the deterioration in the blue phosphor ($BaMgAl_{10}O_{17}$:Eu) during the aging process performed on the PDP may be considered to be a result of deterioration caused by gas, including steam, generated during the aging process by the protective MgO layer on the front plate, the phosphor layer formed on the back plate and the partitions, compounded by deterioration caused by ion impact and vacuum ultraviolet irradiation generated by discharge during the aging process. Since deterioration caused by ultraviolet irradiation is an inevitable consequence of the aging process, reducing the partial pressure of the steam contained in the discharge gas, the other cause of phosphor deterioration, is clearly capable of preventing deterioration in the luminescence characteristics of the blue phosphor ($BaMgAl_{10}O_{17}$:Eu).

In the aging process itself, the fact that discharge occurs in the narrow spaces formed by the partitions, causing the gas containing steam generated by the protective layer (MgO), the phosphor layer and the partitions to be trapped in these spaces is likely to have an impact on the phosphors. In other words, when discharge occurs the surface of the phosphor layer is heated to a high temperature of around 1000° C. by the generated plasma. At such a high temperature, sputtering is caused as steam generated by the plasma makes contact with the surface of the phosphor layer, causing phosphors to deteriorate.

Accordingly, heat deterioration in the phosphors caused by contact between the gas and the phosphor layer can be prevented by evacuating the gas, including steam, produced during discharge from the discharge space.

In this embodiment, a discharge gas was circulated through the inside of the panel continuously during the aging process, but the same effect may be achieved by circulating the discharge gas inside the panel intermittently by repeating the introduction and evacuation of the discharge gas at intervals. Although introduction and evacuation of the discharge gas is performed only intermittently, the gas including steam inside the discharge space can still be evacuated effectively.

Alternatively, a plurality of discharges may take place intermittently, so that the discharge gas in the discharge space can be replaced in the intervals between discharges. In this case, two or more air vents are unnecessary, as gas can be exchanged between discharges using only one air vent to perform both introduction and evacuation.

If the discharge gas circulated through the inside of the panel includes an overly large amount of steam, this steam will make contact with the phosphors, resulting in heat deterioration. Thus, the discharge gas introduced inside the panel should preferably be a dry gas containing as little steam as possible.

If the results shown in FIGS. 14 and 15 are also taken into account, the partial pressure of the steam in the gas circulated through the space between the plates should be of 15 torr or less (i.e. have a vaporization point of 20° C. or lower). The lower the partial pressure of the steam the more the deterioration in luminescence characteristics for the phosphors can be limited, so a partial pressure of 10 torr or less (a vaporization point of 10° C. or less), 5 torr or less (1° C. or lower), 1 torr or less (−20° C. or less) or even 0.1 torr or less (−40° C. or less) is desirable if it can be achieved.

First Study

TABLE 1

PANEL LUMINESCENCE CHARACTERISTICS

| PANEL NUMBER | PANEL LUMINANCE ($cd/m^2$) | COLOR TEMPERATURE WHEN ALL CELLS IN PANEL IGNITED (k) |
|---|---|---|
| 1 | 520 | 8100 |
| 2 | 500 | 7000 |
| 3 | 470 | 6300 |

Table 1

A PDP 1 in. Table 1 is a PDP relating to this study, which was manufactured by performing an aging process based on the above embodiment on a panel constructed as shown in FIG. 8. The discharge gas introduced during the aging process was a mixture of Ne and Xe in a ratio of 95:5, and the partial pressure of the steam contained in the gas introduced inside the plates 1 torr or less. The discharge gas pressure was 500 torr.

Figure 16:
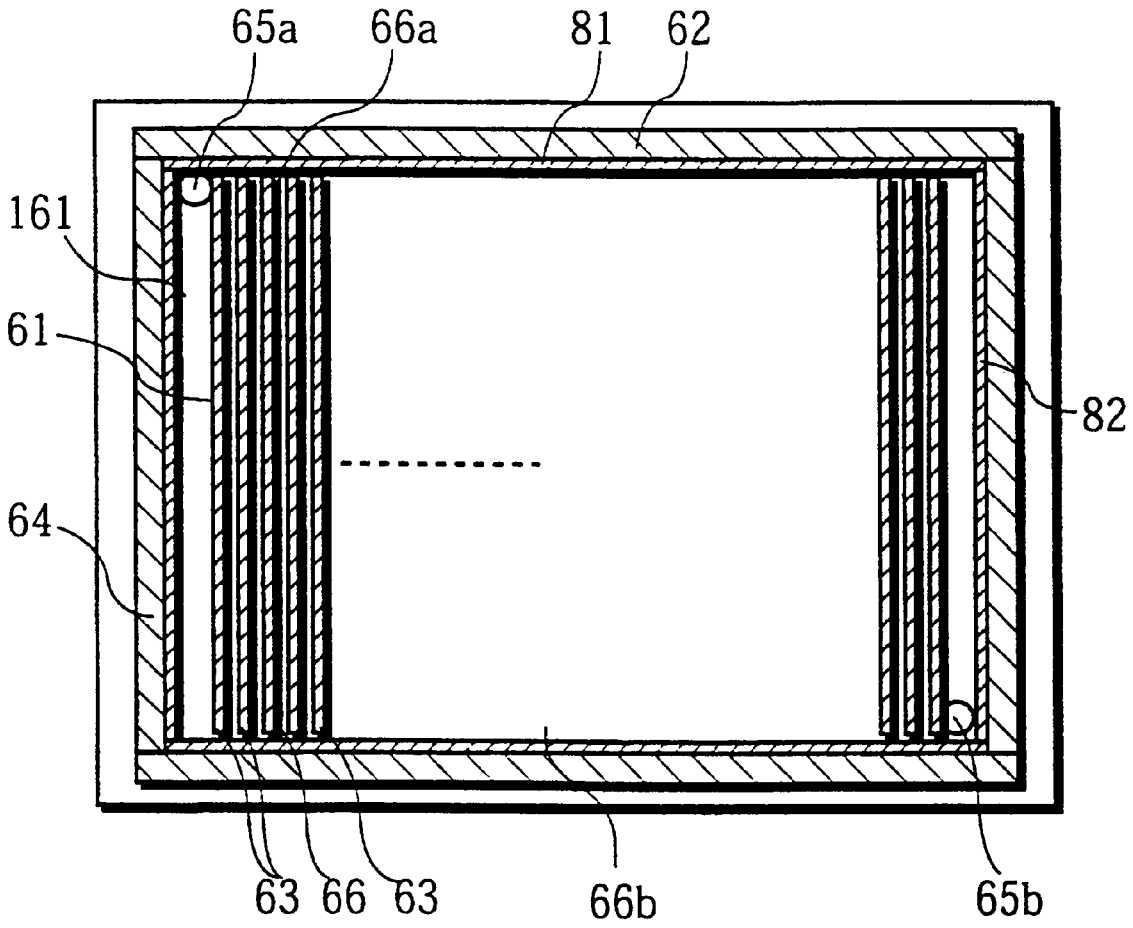
FIG. 16 is a top-view showing the relative placement of partitions, sealing glass and air vents on a back plate.

A PDP represented by the number 2 in the table is a PDP relating to this study, which was constructed as shown in FIG. 16, so that the shortest distance between the barrier 81 running at right angles to the partitions 61, and the partition ends 63 is as narrow as possible when compared to the shortest distance between the barrier 81 running parallel to the partitions 61 and the nearest partition 61. An aging process was performed on this panel in the same way as in the above embodiment.

A PDP represented by the number 2 in the table is a PDP relating to this study, which was constructed as shown in FIG. 16, so that the shortest distance between the barrier 81 running at right angles to the partitions 61, and the partition ends 63 is as narrow as possible when compared to the shortest distance between the barrier 82 running parallel to the partitions 61 and the nearest partition 61. An aging process was performed on this panel in the same way as in the above embodiment.

The discharge in the aging process was performed on each of the above PDPs for 12 hours, and other manufacturing processes were performed under the same conditions for each PDP. Furthermore, the construction of the panel, apart from the air vents and the barriers, was the same in each case. The thickness of the phosphor layer was 30 μm and a discharge gas of 95% Ne to 5% Xe was introduced. Aging was performed by applying a pulse alternating current of 200 V, 50 Hz alternately between discharge electrodes.

After aging was completed, white ignition was performed by igniting all the cells in the manufactured panels to assess their luminescence characteristics (the results of this assessment are shown in Table 1). PDP 1 showed the most satisfactory characteristics. The reason that the characteristics of PDP 1 were more satisfactory than those of PDP 2 is most likely because PDP 1 allowed the even flow of discharge gas through the lines of passages between the partitions and evacuated the gas containing steam generated inside of the panel efficiently during the aging process. In PDP 2, in contrast, most of the discharge gas introduced from the air vent 65*a* passed into a space 161 formed between the leftmost (in the drawing) partition and the barrier 82 before flowing into a space 66*b* and being evacuated from the air vent 65*b*. As a result, most of the discharge gas was evacuated without being distributed from the space 66*a* above the partition ends into the passages 67, so that the gas containing steam generated in the spaces between the partitions could not be evacuated with any great efficiency.

The PDP 3 could not evacuate the gas containing steam from the spaces between the partitions, so its luminescence characteristics are lower than those of the PDPs 1 and 2.

Both PDPs 1 and 2 have much more highly-developed panel characteristics than the PDP 3 aged using conventional methods. The reason for this is that evacuating gas generated inside the panel during the aging process prevented the panel characteristics from deteriorating.

Figure 17:
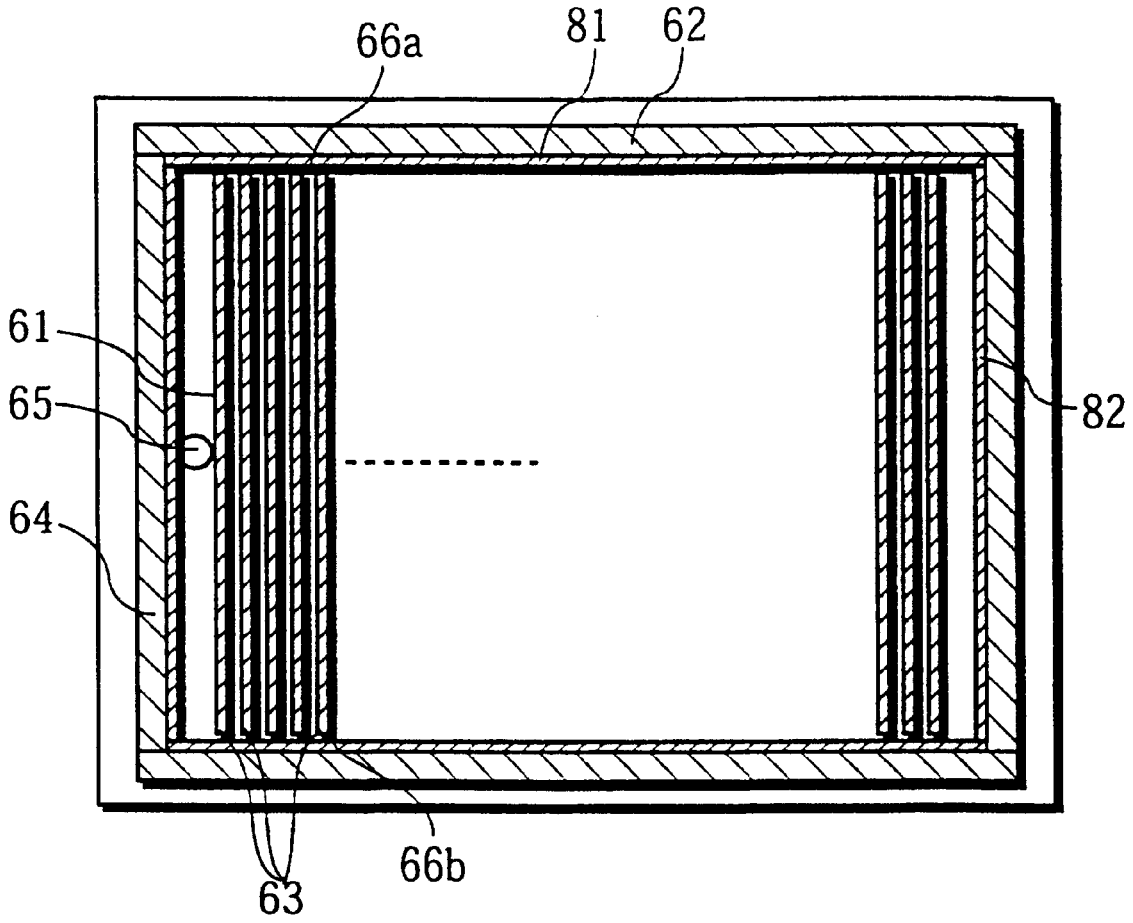
FIG. 17 is a top-view showing the relative placement of partitions, sealing glass and air vents on a back plate.

The luminescence characteristics of panels constructed as shown in FIGS. 8, 16 and 17 were shown by the present study, but panels having a structure like those shown in any one of FIGS. 9 to 12 can evacuate gas generated in the spaces between the lines of partitions efficiently and so luminescence characteristics equivalent to those in the present study may be obtained.

Second Embodiment

In this embodiment, the aging process and subsequent processes differ from those in the first embodiment, but the structure of the PDP and the manufacturing method used are identical, so that only those points unique to this embodiment will be explained here.

In the present embodiment, after the front and back plates have been sealed, the aging process is performed under the conditions normally prevailing in the related art. This method is a simple one, in which a pulse discharge is applied between discharge electrodes to generate a discharge. However, in this conventional aging process, heat deterioration in the phosphors as described above causes a marked deterioration in the luminous intensity and discharge characteristics to occur. This embodiment aims to effectively restore the deterioration in the luminescence characteristics caused to the phosphor layer during the aging process.

With this aim in mind, the following additional processes are performed in the present embodiment after completion of the aging process.

Figure 18:
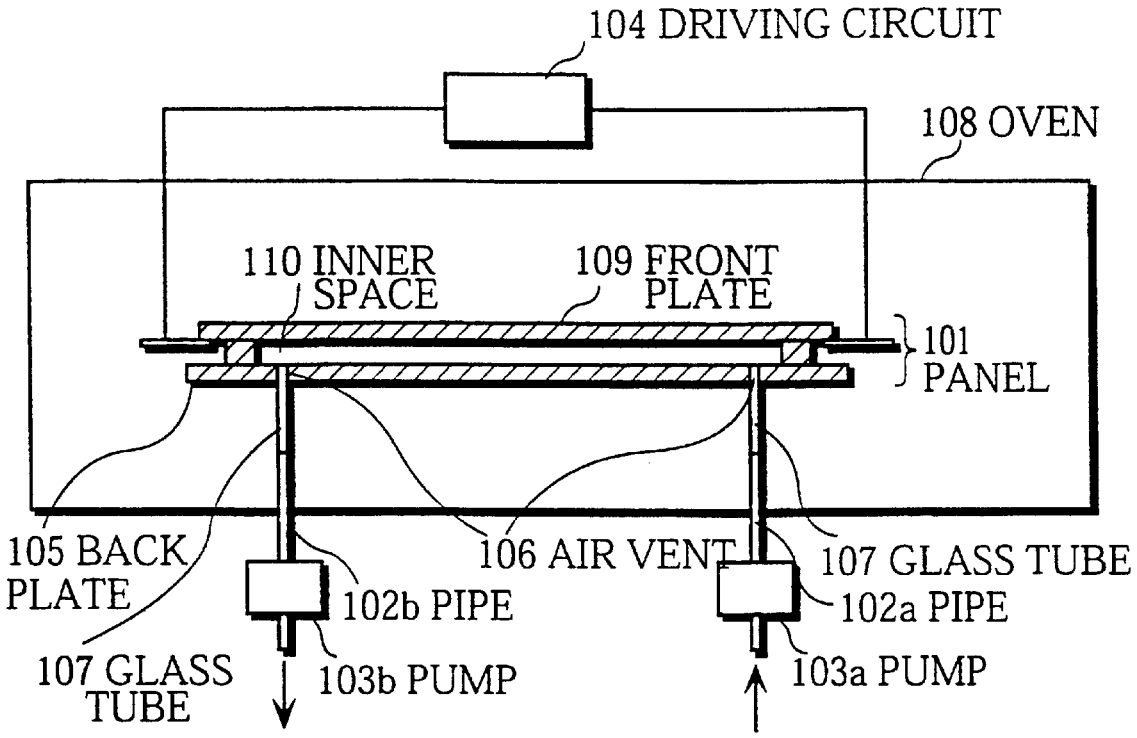
FIG. 18 is a top-view showing a structure for an aging device relating to the second embodiment.

FIG. 18 shows a structure of a panel manufacturing device which performs the aging process and the subsequent heating process in the present embodiment. The panel manufacturing device is constructed from pipes 102*a* and 102*b*, valves 103*a* and 103*b*, a driving circuit 104, and an oven 108. The pipes 102*a* and 102*b* introduce and evacuate gas from the inside of a panel 101. The valves 103*a* and 103*b* regulate the gas pressure inside the panel 101. The driving circuit 104 applies a discharge voltage.

Two or more air vents 106 are formed in the non-display area of a back glass plate 105, upon which address electrodes, a visible light reflective layer, partitions and a phosphor layer are formed, to provide access to the inside of the panel (these include newly-formed air vents in addition to the air vent 21*a*). Glass tubes 107 are attached to these air vents 106. The glass tubes 107 are then connected to pipes 102*a* and 102*b* through which discharge gas is circulated. After this connection is formed, the panel 101 is heated to a certain temperature while its inside is evacuated via pipe 102*b* to form a vacuum (the evacuation process). After the panel is cooled, discharge gas is introduced at a certain pressure via the pipe 102*a*. Then a certain voltage is applied between the electrodes formed on a front plate 109 using the driving circuit 104, generating a discharge inside the panel 101, and aging is performed for a certain time.

The discharge gas used in the present embodiment is an inert gas such as He, Ne, Ar, Xe or a mixture of the above, and the discharge gas pressure is set at between 100 to 760 torr.

After the aging process is completed, the discharge gas inside the panel is evacuated via the pipe 102*b*, and then dry air is introduced via the pipe 102*a*. The panel 101 is heated to a certain temperature such that the sealing glass does not melt, while a constant flow of dry air is continually circulated through the inside of the panel 101.

The PDP is manufactured in the following way. After the panel 101 is cooled, its inside is evacuated via the pipe 102*b* to form a vacuum. Then discharge gas with a certain composition is introduced via the pipe 102*a*, and the glass tubes 107 are sealed.

The deterioration in the luminescence characteristics of the phosphor layer generated during the aging process can be restored by heating the panel after discharge has occurred, as described above. If this heating process is performed so that heating takes place while a dry gas is being fed inside the panel the degree of restoration can be improved. When such a dry gas is used, it can be circulated more efficiently through the discharge space by fixing the position of the air vents as described in the first embodiment (See FIGS. 6 to 12), further improving the degree of restoration.

Alternately, the characteristics of the phosphor layer may be restored simply by evacuating the gas generated inside the panel during heating, rather than by circulating dry gas within the panel, as this process still enables the steam generated inside the panel during the heating process to be evacuated.

The deterioration in the phosphor layer may even be restored to a certain extent merely by introducing dry gas inside the panel, rather than circulating dry gas within the discharge area. However, the amount of steam that can be evacuated is relatively small when compared with the amount evacuated when the gas is circulated through the inner space, and so the degree of restoration is small.

Even if the panel is heated after discharge without evacuating the discharge gas, luminescence characteristics will still be repaired to a certain degree. However, the degree of restoration will be higher if the discharge gas inside the panel is evacuated once after discharge has occurred.

The following is a consideration of how the above method can effectively restore luminescence characteristics.

Table 2 shows changes in luminescence characteristics both before and after an aging process is performed on a plasma display panel. The panel is only coated with the blue phosphor ($BaMgAl_{10}O_{17}$:Eu), since this phosphor is accepted as being particularly susceptible to deterioration of luminescence characteristics during the aging process.

TABLE 2

LUMINESCENSE CHARACTERISTICS OF BLUE PHOSPHOR BEFORE AND AFTER AGING PROCESS

| | RELATIVE LUMINOUS INTENSITY OF BLUE PHOSPHOR | y VALUE OF BLUE PHOSPHOR |
|---|---|---|
| BEFORE AGING PROCESS | 100 | 0.085 |
| AFTER AGING PROCESS | 69 | 0.092 |

Table 2

Luminous intensity was evaluated with 100 taken as the level of luminous intensity prior to the aging process. As well as generating a dramatic deterioration in luminous intensity, the aging process caused the y chromaticity value for the blue phosphor to increase. This demonstrated that the characteristics of the phosphor layer deteriorate by undergoing the aging process.

Figure 19:
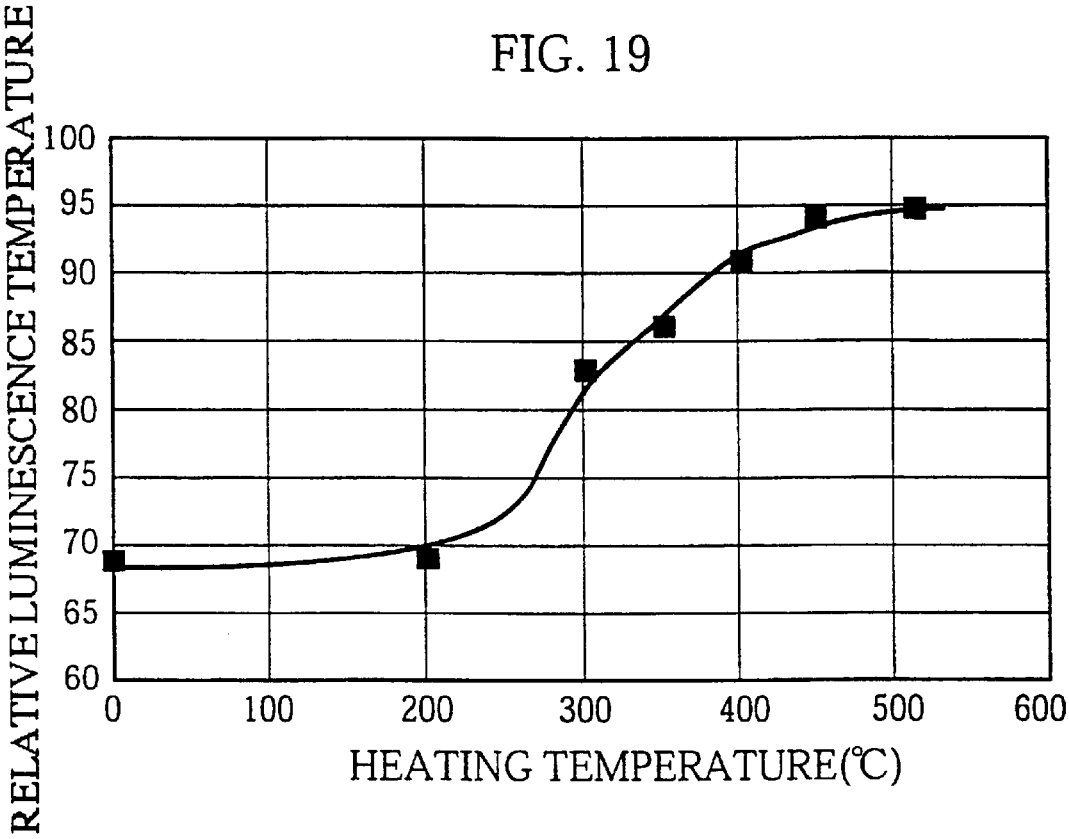
FIG. 19 is a graph showing the heating temperature dependency of the relative change in luminous intensity when the blue phosphor whose luminescent characteristics deteriorated during aging is heated.
Figure 20:
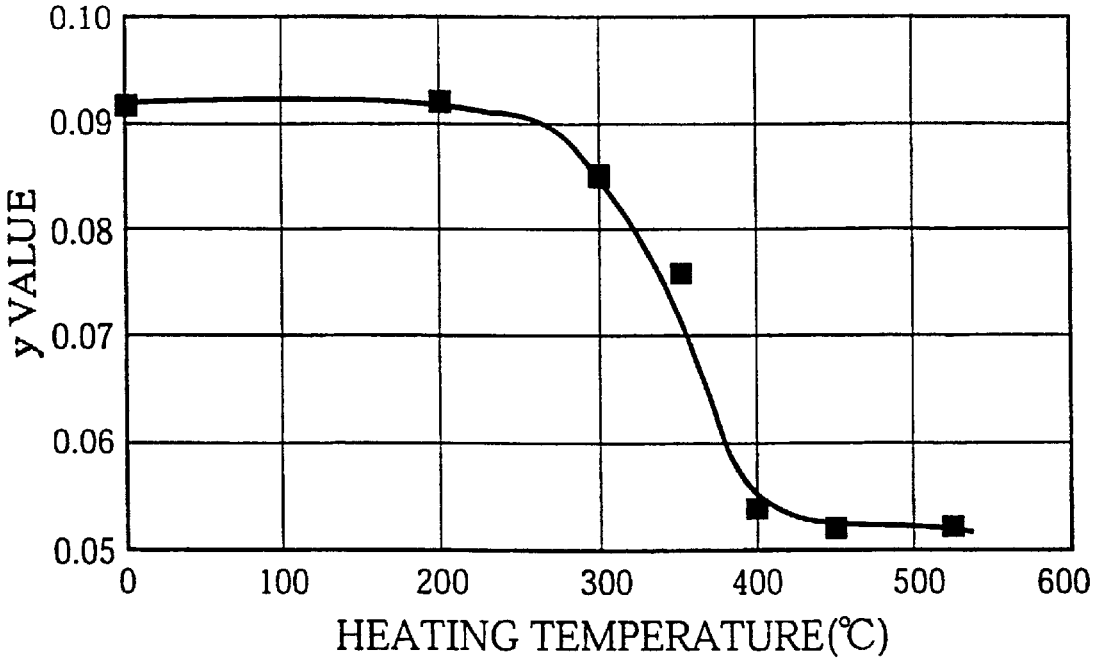
FIG. 20 is a graph showing the heating temperature dependency of the change in the y chromaticity value when the blue phosphor whose luminescent characteristics deteriorated during aging is heated.

FIGS. 19 and 20 show the results for the peak baking temperature dependency for relative luminous intensity and the y chromaticity value respectively. These results were produced by reheating the blue phosphor ($BaMgAl_{10}O_{17}$:Eu), which had experienced deterioration in the y chromaticity value and luminous intensity during the aging process, in dry air (partial pressure of steam 2 torr) at a sustained peak temperature for 30 minutes. Relative luminous intensity was determined by taking the luminous intensity of the blue phosphor prior to the aging process as 100, and the y chromaticity value of a completely unheated blue phosphor was 0.052.

It can be seen that the luminescence characteristics (luminous intensity and the y chromaticity value) of a phosphor which deteriorated during the aging process were restored by reheating the phosphor in a dry atmosphere. In other words, the deterioration of the blue phosphor during the aging process is a reversible reaction. Additionally, a peak baking temperature of from about 300° C. was effective in restoring luminescence characteristics. From this point increases in peak baking temperature caused a corresponding improvement in the luminescence characteristics, but a saturation point was reached at around 500° C. It was also found that lengthening the time at which the phosphor was baked at the peak temperature caused the restoration of the luminescence characteristics to be still greater, although this effect is not shown in the drawings.

Additionally, although not shown in the drawings, heating the phosphor in a gas composed of a mixture of Ne and Xe demonstrated that the atmosphere in which heating is performed has little impact on the restoration of the y chromaticity value, which showed the same rate of improvement here as was the case when dry air was used. The restoration of luminescence characteristics, however, was found to be greater when heating was performed in dry air rather than in a Ne/Xe mixture. The reason for this is that the change in y a chromaticity value is caused by steam, meaning that restoration depends not on the type of gas used, but on the partial pressure of the steam. In contrast, regaining luminous intensity necessitates that the damage generated in the phosphor by ion impact and vacuum ultraviolet irradiation be restored. As a result, reheating in an atmosphere containing oxygen is likely to increase the degree of restoration.

The following is a consideration of the relation between the partial pressure of steam contained in the dry air and the degree of luminescence characteristic restoration. As explained above, lowering the partial pressure of the steam in the dry air makes the generation of heat deterioration produced by steam coming into contact with the phosphor less likely. Thus, reducing the partial pressure of the steam increases the rate of restoration for the luminescence characteristics of the blue phosphor, with the best results being obtained starting from a partial pressure of around 15 torr (a vaporization point of 20° C. or less). Since the deterioration in luminescence characteristics can be further restricted by reducing the partial pressure of the steam further, a partial pressure of 10 torr or less (a vaporization point of 10° C. or less), 5 torr or less (1° C. or less), 1 torr or less (−20° C. or less) or even 0.1 torr or less (−40° C. or less) is desirable if it can be achieved. The relation between the partial pressure of steam in the dry air and the effect on restoration is also supported by the graphs shown in FIGS. 14 and 15. Since the drawings are graphs showing characteristics obtained when a discharge has been performed, however, while here we are concerned with the relation between the degree of restoration in deteriorated phosphor characteristics and the partial pressure of steam in the healing atmosphere, it is not possible to state that the effects shown in FIGS. 14 and 15 are exactly the same. However, they do show the same general trend.

Second Study

TABLE 3

PANEL HEATING CONDITIONS AND LUMINESCENCE CHARACTERISTICS

| PANEL NUMBER | DRY GAS TYPE USED DURING HEATING | PEAK HEATING TEMPERATURE (° C.) (SUSTAINED FOR 30 MINS) | RELATIVE LUMINOUS INTENSITY OF BLUE PHOSPHOR | Y VALUE OF BLUE PHOSPHOR | COMPARISON OF PEAK INTENSITY OF LIGHT SPECTRUM (BLUE/GREEN) | WHITE COLOR TEMPERATURE ALL CELLS IGNITED(K) |
|---|---|---|---|---|---|---|
| 1 | DRY AIR | 350 | 125 | 0.076 | 1.05 | 9300 |
| 2 | DRY AIR | 390 | 131 | 0.059 | 1.15 | 10600 |
| 3 | DRY AIR | 410 | 135 | 0.053 | 1.19 | 11000 |
| 4 | Ne-Xe | 350 | 112 | 0.076 | 0.94 | 8400 |
| 5 | VACUUM | 350 | 110 | 0.075 | 0.91 | 7800 |
| 6 | DRY AIR | 350 | 127 | 0.076 | 1.09 | 9600 |
| 7 | DRY AIR | 350 | 125 | 0.078 | 1.04 | 9000 |
| 8 | Ne-Xe | 350 | 106 | 0.080 | 0.80 | 7000 |
| 9 | — | — | 100 | 0.092 | 0.67 | 5800 |

Table 3

PDPs Nos 1 to 8 shown in Table 3 are PDPs manufactured based on above the embodiments. The panels 1 to 4 are all panels in which the heating process following the aging process was performed in the following way. First the panels were heated to a certain temperature while a dry gas (partial pressure of steam 2 torr) was circulated through the space between them. Then the panels were cooled and evacuated, and a discharge gas introduced. The panels varied in the heating temperature and type of gas used. It should be noted that the peak heating temperature (highest temperature) was sustained for 30 minutes. After the aging process, the PDP 5 shown in Table 3 was heated while the inside of the panel was evacuated. Then the panel was cooled and evacuated, and a discharge gas introduced.

The PDP 6 was heated to a certain temperature while dry air (partial pressure of steam 2 torr) was circulated through the inside of the panel. The panel then continued to be heated while it was evacuated. It was then cooled, and a discharge gas introduced.

In the case of the PDP 7, dry air (partial pressure of steam 2 torr) was introduced, and then the panel was heated with the dry gas sealed inside without being circulated. The panel was cooled and then evacuated, before a discharge gas was introduced. The PDP 8 is a panel manufactured using conventional methods, which was simply heated after the aging process.

The PDP 9 was included for the sake of comparison, and is a panel manufactured using conventional methods, exhibiting the luminescence characteristics shown following the completion of the aging process.

Discharge performed during the aging process took place for each of these PDPs for 24 hours, and the manufacturing process up until the end of the aging process was performed under the same conditions for all of the PDPs. All of the panels had the same panel structure, the thickness of the phosphor layer in each case being 30 $\mu$m and the discharge gas a mixture of Ne (95%) and Xe (5%) introduced at a pressure of 500 torr. The luminous intensity and y chromaticity value measured when the blue phosphor was ignited were taken as luminescence characteristics. Furthermore, the color temperature of the panel at a white balance without color adjustment (the panel color temperature when the blue, green and red cells were caused to emit the same electric power creating a white display) and the peak intensity of the light spectrum produced when the blue and green cells were caused to emit the same electric power (blue and green colors) are measured. The luminous intensity of the panel 9 is shown as 100 to form a relative luminous intensity value for the sake of comparison.

If the luminescence characteristic results are examined, it can be seen that all of the PDPS 1 to 8 in the present experiment have better luminescence characteristics than the conventional PDP 9.

If the data for PDPS 1 to 3 is compared, it becomes clear that the luminescence characteristics for panels heated at a higher temperature following the aging process are more satisfactory. This is because increases in the heating temperature improve the restoration rate for the blue phosphor damaged during the aging process.

Furthermore, if the data for PDPs 1, 4 and 5 is compared, it can be seen that a dry gas including oxygen is the heating atmosphere providing the most satisfactory luminescence characteristics. This is due to the fact that oxygen lost from the phosphor during the aging process can be restored by heating the panel in an atmosphere including oxygen.

Additionally, if the data for PDPs 1 and 6 is compared, is can be seen that the luminescence characteristics for a PDP which is evacuated without being cooled after the aging process are more satisfactory. This is because performing evacuation without cooling in this manner enables the adsorption gas from inside the panel to be evacuated efficiently.

Even if the gas is simply sealed inside the panel without being circulated, a certain amount of improvement in luminescence characteristics can be obtained, as shown by the data for the PDP 7.

A comparison of the data for the PDPs 4 and 8 shows that a measure of improvement in luminescence characteristics can be obtained just by heating the panel after the aging process, but that a greater degree of restoration can be obtained by evacuating the inside of the panel once before the heating is performed (see the results for PDP 8). Additionally, improved panel characteristics can be obtained by heating the panel following the aging process without evacuating it even once, so that it is heated with gas containing steam still remaining inside, as is the case with the PDP 8. The reason for this is that the influence of ultraviolet rays on the phosphor during discharge is less than it would be if discharge took place when a large amount of gas containing steam was still present inside the panel.

If the panel is heated to a temperature of 370° C. or more during the heating process following the aging process, the luminous intensity improves considerably, while almost uniform chromaticity values can be obtained. Heating the panel to a temperature of 400° C. or more allows even higher luminous intensity to be obtained.

Measurements for color temperature that has not received color adjustment, and for peak intensity comparisons in the light spectrum of the blue and green phosphors can be obtained by operating a manufactured PDP, or by taking measurements in the following way.

The front and back plates are taken apart, and an ultraviolet lamp used to shine ultraviolet rays onto phosphor layer exposed on the back plate, and the visible light generated is measured. When the above panel was measured using this method the same values were obtained as was the case when the manufactured PDP was activated and measurements taken. This method is particularly valuable when the visible light generated by the phosphors cannot be accurately caught, such as when colored glass is used for the front plate.

The present invention need not be limited to the above mentioned embodiments, and the following variations are also possible.

For example, when the sealing process is performed, as in the first embodiment, using a conventional method (a method in which the front and back panels are simply heated in an oven), the heat deterioration generated during the sealing process may be restored by heating the panel at a certain temperature once the aging process is complete, as is performed in the second embodiment.

In the second embodiment, the whole panel was placed in an oven and heated to restore the characteristics of the phosphor after the aging process, but this restoration may be performed by heating only the phosphor layer. For example, a laser beam may be scanned across the front plate on top of the phosphor layer and the surface of the back plate in order to heat the phosphor layer. This method, unlike the case in which the whole panel is heated, enables the phosphor layer to be heated without heating the sealing glass, so the phosphor layer may be heated to a temperature higher than the softening point of the sealing glass. Specifically, when the characteristics of the phosphor layer are restored by a heating process, the panel may be heated until it reaches a saturation temperature of 500° C. Accordingly, differences in the heating temperature cease to cause differences in the degree of restoration. This process should preferably be performed while dry gas is being circulated through the inside of the panel, while the inside of the panel is being evacuated, or after the partial pressure of the steam inside the panel has been reduced and a dry gas introduced. It may also be possible to heat the panel to a temperature of around 500° C. using an oven, but the temperature attainable in this method is limited by the softening point of the sealing glass. If the softening point of the sealing glass is less than 500° C., it is impossible to heat the panel to a temperature of 500° C. or more. The laser method is, however, not restricted by the softening point of the sealing glass.

Alternately, the phosphors can be heated by circulating a heating medium, such as an inert gas heated to a certain temperature, inside the discharge area, thus restoring the characteristics of the phosphor. As was the case with the laser method and unlike the method in which the whole panel is heated, this method heats the phosphors without heating the sealing glass, so the phosphors may be heated to a temperature higher than the softening point of the sealing glass.

When the method used in the second embodiment is combined with that of the first embodiment, heating the panel while circulating a gas including oxygen inside it is preferable as the oxygen lost from the phosphors can be restored.

Furthermore, the phosphors need not be made from the above mentioned materials, and may be composed as shown below.

| | |
|---|---|
| Blue phosphor: | (Ba,Sr) $MgAl_{10}O_{17}$ : Eu |
| Green phosphor: | $BaAl_{12}O_{19}$ : Mn |
| Red phosphor: | (Y,Gd) $BO_3$ : Eu |

Finally, the above embodiments showed an example of a surface discharge PDP, but may equally apply to an opposing discharge PDP. The same effects may also be obtained for a DC PDP.

Possible Industrial Application

The PDP manufacturing method in the present invention may be used to manufacture PDPs for use as display screens in televisions, computer monitors and the like.

What is claimed is:

1. A PDP manufacturing method, for manufacturing a PDP comprising:

a front plate and a back plate, on at least one of which discharge electrodes have been arranged and on at least one of whose inner surfaces a blue phosphor layer including $BaMgAl_{10}O_{17}$:Eu has been formed, the front and back plates being sealed together so that an inner space is formed therebetween;

an aging process then being performed by applying a required discharge voltage to the discharge electrodes while a discharge gas is present in the inner space; and a heating process is performed, following the aging process, by heating phosphors forming the blue phosphor layer to restore luminous intensity and luminescent chromaticity characteristics of the phosphors.

2. The PDP manufacturing method of claim 1, wherein the heating process following the aging process is performed by heating the phosphors to a temperature of at least 300° C.

3. The PDP manufacturing method of claim 2, wherein the heating process following the aging process is performed by heating the phosphors using one of:

(a) heating the entire panel in an oven;

(b) shining a laser beam on to a part of the plates on which the phosphors are positioned; and (c) circulating a heating medium around the inner space.

4. The PDP manufacturing process of claim 3, wherein the heating process following the aging process is performed while the gas is evacuated from the inner space.

5. The PDP manufacturing process of claim 3, wherein the phosphors are heated following the aging process, once gas have been evacuated from the inner space and a dry gas introduced.

6. The PDP manufacturing method of claim 3, wherein the heating process following the aging process is performed while a dry gas is introduced through the first air vent formed in the panel and the introduced dry gas evacuated through the second air vent formed in the panel.

7. The PDP manufacturing method of claim 6, wherein the PDP subjected to the heating process has the following structure:

a plurality of discharge spaces are formed by arranging a plurality of partitions to divide up the inner space between the front plate and the back plate;

a sealing glass layer for sealing the front plate to the back plate is included between the perimeters of the front plate and the back plate;

a first space connected to the discharge spaces formed by the plurality of partitions is formed between first ends of the plurality of partitions and the sealing glass layer, a second space connected to the discharge spaces is formed between second ends of the plurality of partitions and the sealing glass layer, the first air vent is formed to connect with the first space, and the second air vent is formed to connect with the second space, wherein the above structure is subject to a heating process in which a dry gas is circulated through the discharge space by performing the introducing process by introducing the dry gas into the first space via the first air vent and the evacuating process by evacuating the dry gas from the second space via the second air vent.

8. The PDP manufacturing method of claim 7, further having a structure which the discharge gas mainly flows through a plurality of gas passages leading from the first space into the second space.

9. The PDP manufacturing method of claim 8, further having a structure in which a minimum distance between partition ends of the plurality of partitions, excluding at least a partition furthest from the first air vent, and the sealing glass layer bordering the first space is more than a minimum distance between the sealing glass layer parallel to the partitions and an adjacent partition.

10. The PDP manufacturing method of claim 9, further including a structure in which the first air vent is formed in the vicinity of one of the outermost partitions, and the second air vent is formed in the vicinity of the other outermost partition, on an opposite side to the first air vent.

11. The PDP manufacturing method of claim 8, further having a structure in which one part of each outermost partition among the plurality of partitions and one part of the sealing glass layer are connected to prevent dry gas from flowing into space between the outermost partitions and the sealing glass layer.

12. The PDP manufacturing method of claim 11, further including a structure in which the first air vent is formed in the vicinity of one of the outermost partitions, and the second air vent is formed in the vicinity of the other outermost partition, on an opposite side to the first air vent.

13. The PDP manufacturing method of claim 6, wherein the PDP subjected to the heating process has the following structure:

a plurality of discharge spaces are formed by arranging a plurality of partitions to divide up the inner space between the front plate and the back plate;

a sealing glass layer for sealing the front plate to the back plate is included between the perimeters of the front plate and the back plate;

a barrier is included between the front plate and the back plate, around the inside of the sealing glass layer;

a first space connected to the discharge spaces formed by the plurality of partitions is formed between first ends of the plurality of partitions and the barrier, a second space connected to the discharge spaces is formed between second ends of the plurality of partitions and the barrier, the first air vent is formed to connect with the first space, and the second air vent is formed to connect with the second space, wherein the above structure is subject to a heating process in which the dry gas is circulated through the discharge space by performing the introducing process by introducing the dry gas into the first space via the first air vent and the evacuating process by evacuating the dry gas from the second space-via the second air vent.

14. The PDP manufacturing method of claim 13, further having a structure which the discharge gas mainly flows through a plurality of gas passages leading from the first space into the second space.

15. The PDP manufacturing method of claim 14, further having a structure in which a minimum distance between partition ends of the plurality of partitions, excluding at least a partition furthest from the first air vent, and the barrier bordering the first space is more than a minimum distance between the barrier parallel to the partitions and an adjacent partition.

16. The PDP manufacturing method of claim 15, further having a structure in which:

the first air vent is formed in the vicinity of one of the outermost partitions, and the second air vent is formed in the vicinity of the other outermost partition, on an opposite side to the first air vent.

17. The PDP manufacturing method of claim 14, further having a structure in which one part of each outermost partition among the plurality of partitions and one part of the barrier are connected to prevent discharge gas from flowing into space between the outermost partitions and the barrier.

18. The PDP manufacturing method of claim 17, further having a structure in which:

the first air vent is formed in the vicinity of one of the outermost partitions, and the second air vent is formed in the vicinity of the other outermost partition, on an opposite side to the first air vent.

19. The PDP manufacturing method of claim 6, wherein the dry gas includes an inert gas.

20. The PDP manufacturing method of claim 6, wherein the dry gas includes oxygen.

21. The PDP manufacturing method of claim 3, wherein an evacuating process for evacuating the introduced-dry gas from the inner space between the plates heated by the heating process following the aging process is performed while the plates are still hot.

22. The PDP manufacturing method of claim 1, wherein the heating process following the aging process is performed by heating the phosphors to a temperature of at least 370° C.

23. The PDP manufacturing method of claim 22, wherein the heating process following the aging process is performed by heating the phosphors using one of:

(a) heating the entire panel in an oven;

(b) shining a laser beam on to the part of the plates on which the phosphors are positioned; and (c) circulating a heating medium around the inner space.

24. The PDP manufacturing process of claim 23, wherein the heating process following the aging process is performed while the gas is evacuated from the inner space.

25. The PDP manufacturing process of claim 23, wherein the phosphors are heated following the aging process, once gas has been evacuated from the inner space and a dry gas introduced.

26. The PDP manufacturing method of claim 23, wherein the heating process following the aging process is performed while a dry gas is introduced through the first air vent formed in the panel and the introduced dry gas evacuated through the second air vent formed in the panel.

27. The PDP manufacturing method of claim 23, wherein an evacuating process for evacuating an introduced dry gas from the inner space between the plates heated by the heating process following the aging process is performed while the plates are still hot.

28. The PDP manufacturing method of claim 22, wherein the heating process following the aging process is performed by heating the phosphors to a temperature of at least 400° C.

29. The PDP manufacturing method of claim 28, wherein the heating process following the aging process is performed by heating the phosphors using one of:

(a) heating the entire panel in an oven;

(b) shining a laser beam on to the part of the plates on which the phosphors are positioned; and (c) circulating a heating medium around the inner space.

30. The PDP manufacturing process of claim 29, wherein the heating process following the aging process is performed while the gas is evacuated from the inner space.

31. The PDP manufacturing process of claim 29, wherein the phosphors are heated following the aging process, once gas has been evacuated from the inner space and a dry gas introduced.

32. The PDP manufacturing method of claim 29, wherein the hearing process following the aging process is performed while a dry gas is introduced through the first air vent formed in the panel and the introduced dry gas evacuated through the second air vent formed in the panel.

33. The PDP manufacturing method of claim 29, wherein the evacuating process for evacuating the introduced-dry gas from the inner space between the plates heated by the heating process following the aging process is performed while the plates are still hot.

34. The PDP manufacturing method of claim 1, wherein the heating process following the aging process is performed by heating the phosphors to a temperature of at least 500° C.

35. The PDP manufacturing method of claim 34, wherein the heating process following the aging process is performed by heating the phosphors using one of (a) shining a laser beam on to the part of the plates on which the phosphors are positioned, and (b) circulating a heating medium around the inner space.

36. The PDP manufacturing process of claim 35, wherein the heating process following the aging process is performed while the gas is evacuated from the inner space.

37. The PDP manufacturing process of claim 35, wherein the phosphors are heated following the aging process, once gas has been evacuated from the inner space and a dry gas introduced.

38. The PDP manufacturing method of claim 35, wherein the heating process following the aging process is performed while a dry gas is introduced through the first air vent formed in the panel and the introduced dry gas evacuated through the second air vent formed in the panel.

39. The PDP manufacturing method of claim 35, wherein the evacuating process for evacuating an introduced dry gas from the inner space between the plates heated by the heating process following the aging process is performed while the plates are still hot.

* * * * *

UNITED STATES PATENT AND TRADEMARK OFFICE

CERTIFICATE OF CORRECTION

PATENT NO. : 6,666,738 B1
DATED : December 23, 2003
INVENTOR(S) : Hiroyuki Kado et al.

It is certified that error appears in the above-identified patent and that said Letters Patent is hereby corrected as shown below:

Column 26,
Line 45, please delete “hearing” and insert -- heating --.

Signed and Sealed this

Fourteenth Day of September, 2004

JON W. DUDAS
*Director of the United States Patent and Trademark Office*